US012571538B2

(12) United States Patent
Sampath et al.

(10) Patent No.: US 12,571,538 B2
(45) Date of Patent: Mar. 10, 2026

(54) COMBUSTION LINER ASSEMBLY

(71) Applicant: General Electric Company, Schenectady, NY (US)

(72) Inventors: Karthikeyan Sampath, Bengaluru (IN); Perumallu Vukanti, Bengaluru (IN); Pradeep Naik, Bengaluru (IN); Ravindra Shankar Ganiger, Bengaluru (IN); Daniel J. Kirtley, Blue Ash, OH (US); Arvind Namadevan, Bengaluru (IN); Ranganatha Narasimha Chiranthan, Bengaluru (IN); Hiranya Nath, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 17/812,278

(22) Filed: Jul. 13, 2022

(65) Prior Publication Data

US 2023/0296251 A1 Sep. 21, 2023

(30) Foreign Application Priority Data

Mar. 16, 2022 (IN) ..... 202211014234

(51) Int. Cl.
*F23R 3/00* (2006.01)

(52) U.S. Cl.
CPC .... *F23R 3/007* (2013.01); *F23R 2900/00012* (2013.01); *F23R 2900/00017* (2013.01); *F23R 2900/03043* (2013.01)

(58) Field of Classification Search
CPC ..... F23R 3/007; F23R 2900/00012; F23R 2900/00017; F23R 2900/03043; F16B 2200/97; Y10T 403/21; Y10T 403/213; Y10T 403/217
USPC ..... 403/28, 29, 30
See application file for complete search history.

(56) References Cited

U.S. PATENT DOCUMENTS 2,686,655 A * 8/1954 Schorner ..... F01D 5/3084 416/214 R
3,956,886 A 5/1976 Sedgewick
4,281,941 A * 8/1981 Rottenkolber ..... F16D 1/0835 403/29
4,441,324 A * 4/1984 Abe ..... F23R 3/007 60/753

(Continued)

FOREIGN PATENT DOCUMENTS

GB 2432902 B 6/2007

*Primary Examiner* — Devon C Kramer
*Assistant Examiner* — Henry Ng
(74) *Attorney, Agent, or Firm* — Venable LLP; Michael C. Sanko; Michele V. Frank

(57) ABSTRACT

A combustion liner assembly includes metal liner having a hot side and a cold side, a ceramic matrix composite (CMC) liner tile configured to provide a heat shield for the metal liner, the CMC liner tile having a different thermal conductivity than the metal liner, and a connection device configured to attach the CMC liner tile to the metal liner. The connection device accommodates the different thermal conductivity of the CMC liner tile and the metal liner. The connection device is free from a radial fastener exposed to hot gases on the hot side of the metal liner, and the connection device allows radial movement and axial movement between the metal liner and the CMC liner tile.

19 Claims, 14 Drawing Sheets

(56) References Cited

U.S. PATENT DOCUMENTS 4,907,411 A * 3/1990 Krueger ..... F23R 3/007 431/165
5,289,677 A 3/1994 Jarrell
7,779,637 B2 * 8/2010 Heilos ..... F23R 3/007 60/752
8,191,373 B2 6/2012 Berry et al.
8,925,326 B2 1/2015 Cihlar et al.
9,638,133 B2 5/2017 Kramer
9,696,037 B2 7/2017 Kidder et al.
9,829,199 B2 11/2017 Mayer
10,378,772 B2 * 8/2019 Stieg ..... F23R 3/002
10,465,911 B2 11/2019 Sander et al.
10,502,421 B2 12/2019 Harding et al.
10,969,103 B2 4/2021 Chang et al.
11,859,823 B2 * 1/2024 Ganiger ..... F23R 3/60
2003/0079475 A1 * 5/2003 Schmahl ..... F23R 3/002 60/752
2004/0110041 A1 * 6/2004 Merrill ..... F23R 3/007 156/89.12
2005/0242526 A1 * 11/2005 Dahlke ..... F16J 15/064 277/605
2006/0176671 A1 * 8/2006 Heilos ..... F23R 3/007 361/704
2007/0151249 A1 * 7/2007 Barbeln ..... F23R 3/007 60/753
2010/0192587 A1 * 8/2010 Hessler ..... F23R 3/16 60/752
2015/0083305 A1 * 3/2015 Bossmann ..... E04F 13/0885 156/89.11
2016/0131362 A1 * 5/2016 Vogtmann ..... F23M 5/04 60/752
2016/0201910 A1 * 7/2016 Chang ..... F01D 11/08 60/753
2017/0114536 A1 * 4/2017 Tebo ..... B25B 23/06
2017/0138597 A1 * 5/2017 Freeman ..... F01D 9/04
2019/0010825 A1 * 1/2019 Kloetzer ..... F01D 5/3092
2020/0165929 A1 * 5/2020 McCaffrey ..... F01D 11/001
2020/0173661 A1 * 6/2020 Hu ..... F23R 3/002
2020/0355369 A1 * 11/2020 Hu ..... F23R 3/007
2021/0102705 A1 4/2021 Kramer
2021/0108798 A1 * 4/2021 Freeman ..... F23R 3/50
2021/0325043 A1 * 10/2021 Freeman ..... F23R 3/46
2023/0160470 A1 * 5/2023 Cross ..... F16C 27/02 277/434

* cited by examiner

COMBUSTION LINER ASSEMBLY

CROSS REFERENCE TO RELATED APPLICATIONS

The present application claims the benefit of Indian Patent Application No. 202211014234, filed on Mar. 16, 2022, which is hereby incorporated by reference herein in its entirety.

TECHNICAL FIELD

The present disclosure relates to a combustion liner assembly. In particular, the present disclosure relates to a combustion liner assembly having one or more liner tiles coupled to a combustion liner.

BACKGROUND

A gas turbine engine may include a combustion section having a combustor that generates combustion gases discharged into a turbine section of the engine. The combustion section may include a combustion liner. The combustion liner may include one or more liner tiles coupled to a hot side of the combustion liner. The one or more liner tiles may protect the combustion liner.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached," "connected," and the like, refer to both direct coupling, fixing, attaching, or connecting as well as indirect coupling, fixing, attaching, or connecting through one or more intermediate components or features, unless otherwise specified herein.

The singular forms "a," "an," and "the" include plural references unless the context clearly dictates otherwise.

The combustion liners of the present disclosure provide connections between non-ceramic components and ceramic components. For example, the combustion liners of the present disclosure provide metallic liners having ceramic matrix composites (CMC) liner tiles coupled thereto on a hot side of the metallic liner for use in gas turbine engines. The CMC liner tiles provide a heat shield for the combustion liner, enhancing life of the combustion liner. However, the metallic liners have a different thermal conductivity or thermal coefficient than the CMC liner tiles. This results in different rates of expansion and contraction during operation of the gas turbine engine. Accordingly, the connections of the present disclosure provide connections between the liner tiles and the liner that allow for relative movement between parts of the combustion liner assembly to account for the different thermal conductivities of the liner and the liner tiles. The connection devices of the present disclosure allow for relative radial movement and relative axial movement between the liner and the liner tiles.

Figure 1:
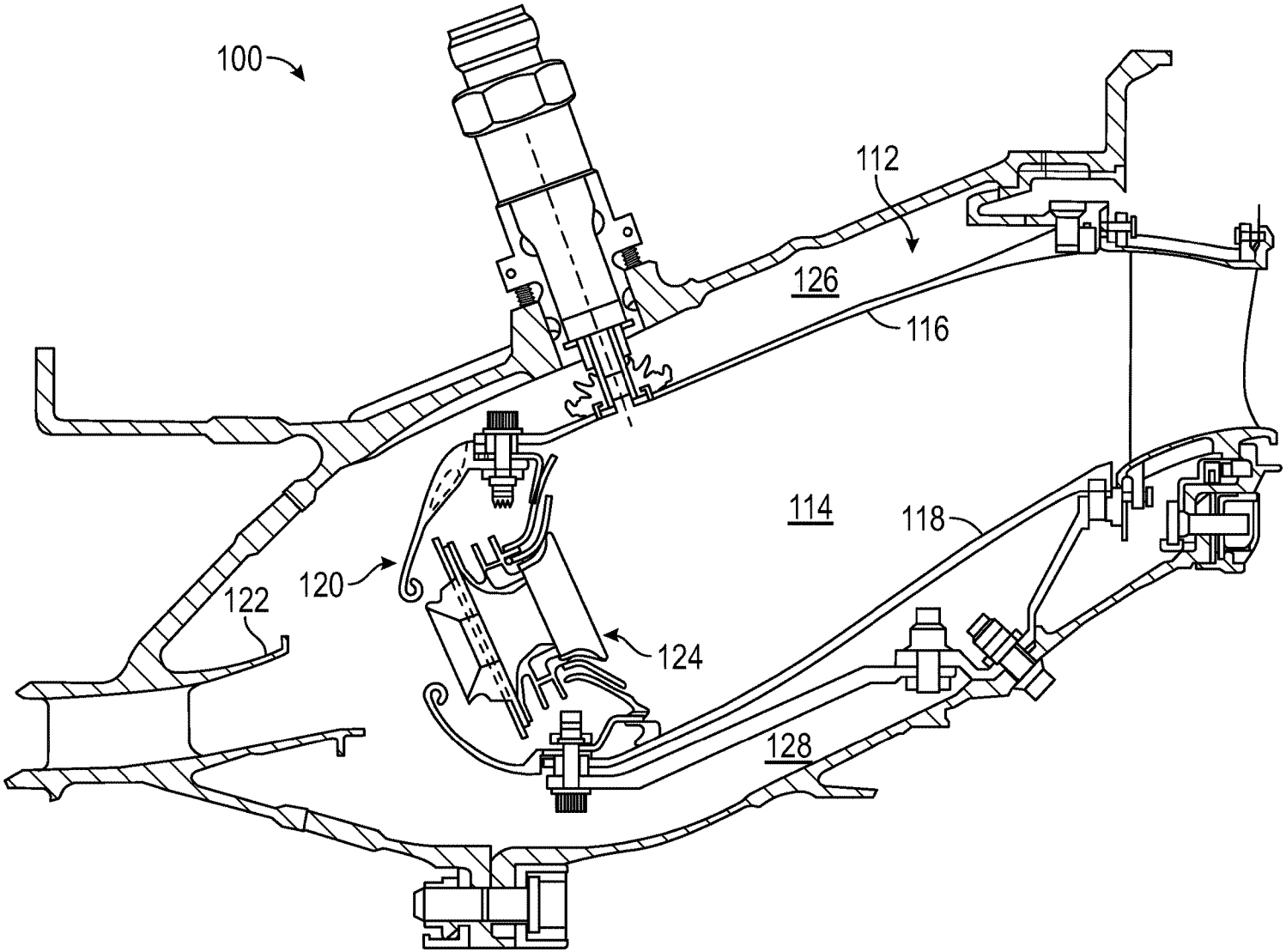
FIG. 1 shows a schematic, cross-sectional view of a combustion section, taken along a centerline of the combustion section, according to an embodiment of the present disclosure.

FIG. 1 shows a schematic, cross-sectional view of a combustion section 100 of a gas turbine engine, according to an embodiment of the present disclosure. The combustion section 100 includes a combustor 112 that generates combustion gases that are discharged into a turbine section (not shown) of the engine. The combustor 112 includes a core primary combustion zone 114. The core primary combustion zone 114 is bounded by an outer liner 116, an inner liner 118, and a cowl 120. Additionally, a diffuser 122 is positioned upstream of the core primary combustion zone 114. The diffuser 122 receives an airflow from the compressor section (not shown) of the engine and provides the flow of compressed air to the combustor 112. The diffuser 122 provides the flow of compressed air to cowl 120 of a swirler 124. Air flows through an outer passage 126 and an inner passage 128.

Figure 2:
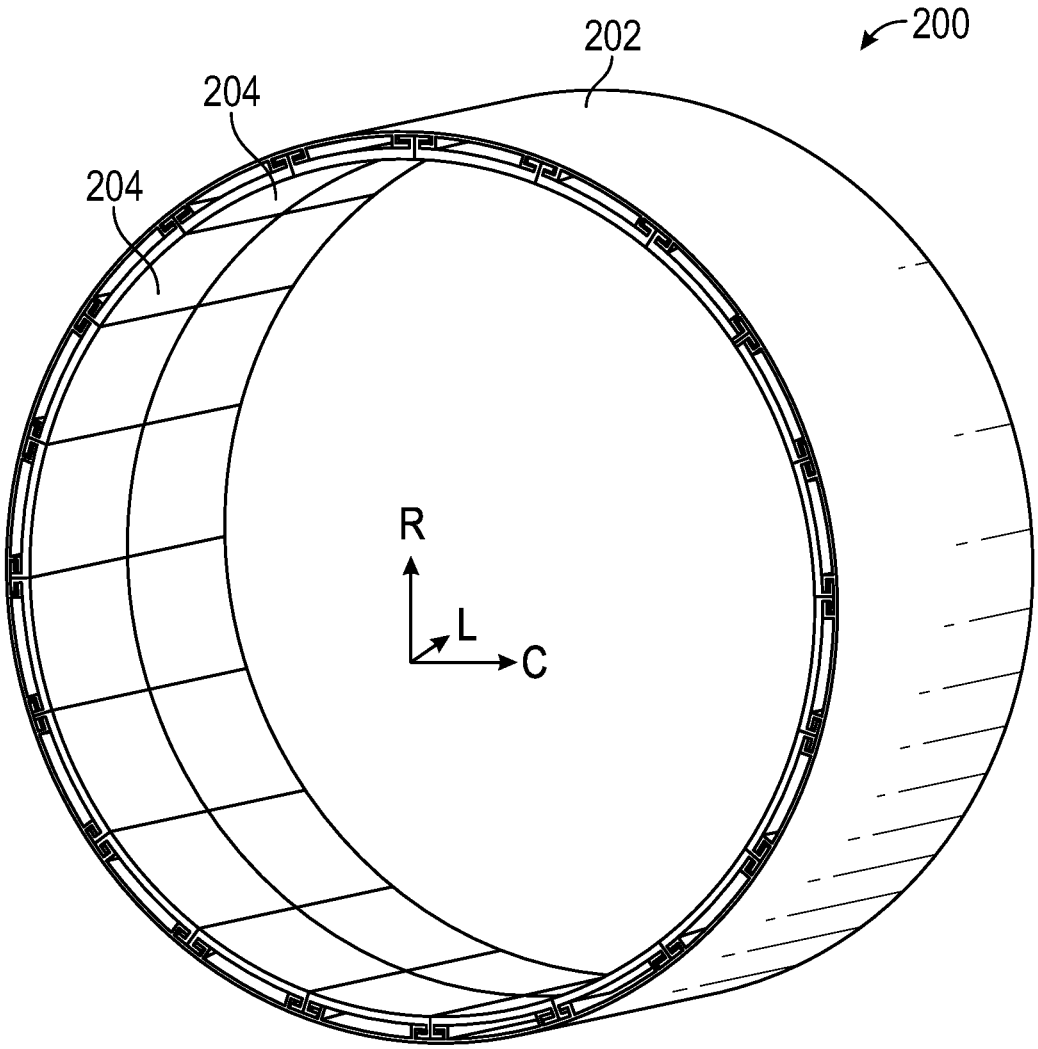
FIG. 2 shows a schematic, perspective view of a combustion liner assembly, according to an embodiment of the present disclosure.

FIG. 2 shows an exemplary combustion liner assembly 200. The combustion liner assembly 200 may be provided in FIG. 1 as the outer liner 116, the inner liner 118, or both the outer liner 116 and the inner liner 118. As shown in FIG. 2, the combustion liner assembly 200 may be oriented to have a radial direction R, a circumferential direction C, and an axial or a longitudinal direction L. The combustion liner assembly 200 may include a combustion liner 202, referred to herein as liner 202. Although depicted as cylindrical, the liner 202 may take any known shape of a combustion liner. The combustion liner assembly 200 may include one or more combustion liner tiles 204, referred to herein, as liner tiles 204. The liner tiles 204 may be arranged on and coupled to a hot side of the liner 202. That is, the liner tiles 204 may be coupled on the side of the liner 202 exposed to the core primary combustion zone 114 (FIG. 1). The liner 202 may be non-ceramic. In some examples, the liner 202 may be a metal liner. The liner tiles 204 may be ceramic. In some examples, liner tiles 204 may be CMC. The connection device 205 allows for relative radial movement between the liner 202 and the liner tiles 204.

Figure 3:
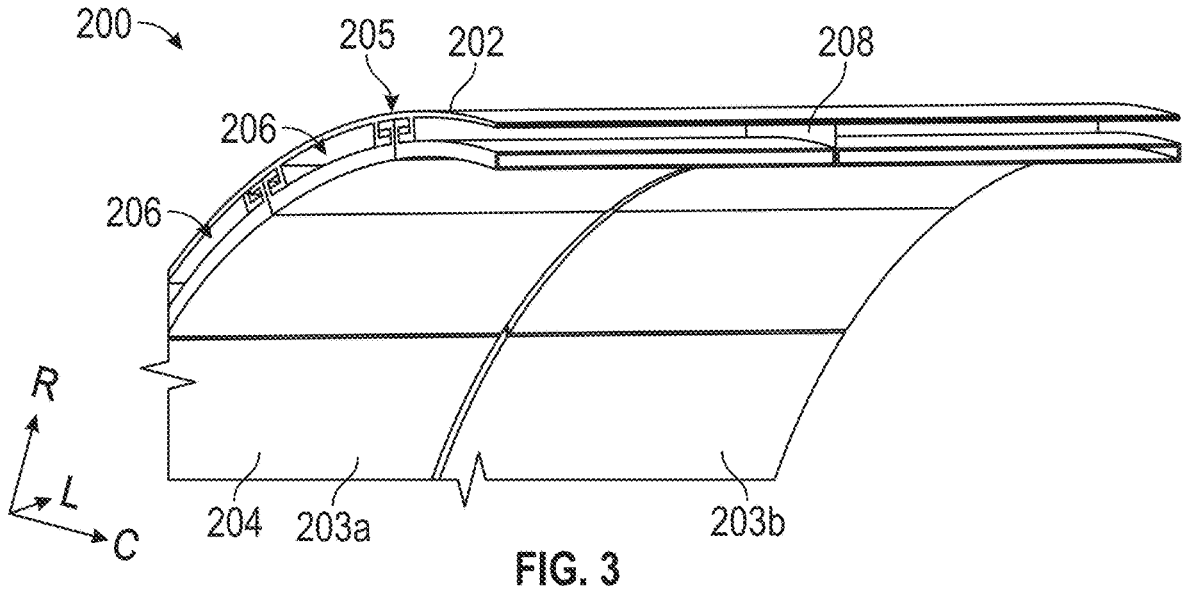
FIG. 3 shows a schematic, partial perspective view of the combustion liner assembly of FIG. 2, according to an embodiment of the present disclosure.
Figure 4:
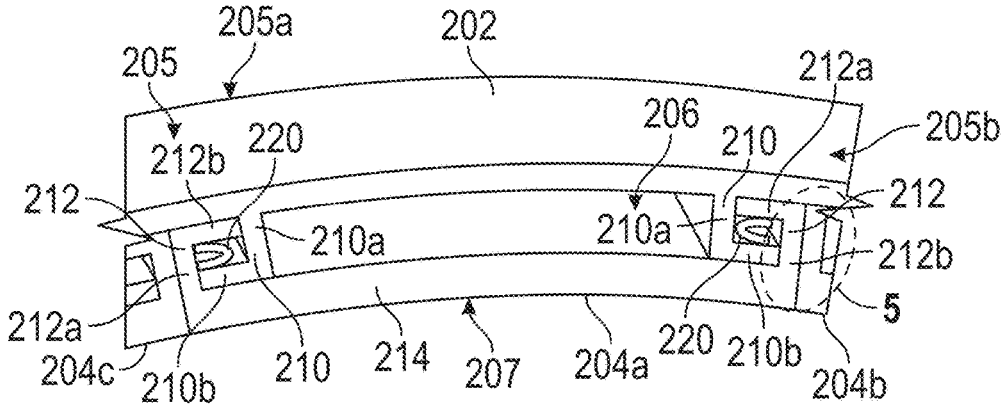
FIG. 4 shows a schematic, close-up view of a portion of the combustion liner assembly of FIG. 2, according to an embodiment of the present disclosure.

FIGS. 3 and 4 show close-up views of the combustion liner assembly 200. Referring first to FIG. 3, the combustion liner assembly 200 may include a connection device 205 that attaches and connects the liner 202 and the one or more liner tiles 204. That is, each of the liner tiles 204 is coupled at the connection device 205 to the liner 202. As shown in FIGS. 3 and 4, each liner tile 204 is connected at opposing ends with a connection device 205. Thus, there are two connection devices 205 for each liner tile 204. A gap or space 206 may be located between a radially outer surface of each of the liner tiles 204 and a radially inner surface of the liner 202. The space 206 may be formed due to the connection device 205.

The liner tiles 204 may include a first set of liner tiles 203*a* and a second set of liner tiles 203*b*. The first set of liner tiles 203*a* may be axially forward (e.g., nearer a compressor of the gas turbine engine) of the second set of liner tiles 203*b*. Although only two sets of liner tiles are shown, more or fewer may be provided along the axially length of the liner 202. The first set of liner tiles 203*a* may be spaced apart from the second set of liner tiles 203*b*. A protrusion 208 extending radially inward from the radially inner surface of the liner 202 may maintain the first set of liner tiles 203*a* and the second set of liner tiles 203*b* in an axially spaced arrangement. That is, the protrusion 208 may limit or prevent movement of the liner tiles 204 in the axial or the longitudinal direction L. In embodiments where more than two sets of liner tiles 204 are provided, additional protrusions 208 may be provided along the axial length of the liner 202 to separate adjacent sets of liner tiles. The protrusion 208 need not connect to the liner tiles 204 and, in some examples, a connection is omitted.

FIG. 4 shows a close-up view of the combustion liner assembly 200 such that the details of the connection device 205 are shown. A connection device 205 may be provided at opposing circumferential ends of the liner tile 204. For example, an exemplary liner tile 204*a* may be connected to the liner 202 at one circumferentially end by the first connection device 205*a* (e.g., the end adjacent exemplary liner tile 204*c*) and may be connected to the liner 202 at another, opposing circumferentially end by the second connection device 205*b* (e.g., the end adjacent exemplary liner tile 204*b*). The connection device 205 may extend along the entire axial length of the liner tile 204, as shown in FIG. 3. Alternatively, the connection device 205 may extend along a partial axial length of the liner tile 204 and/or multiple connection devices 205 may by employed to connect a single liner tile 204 to the liner 202 (e.g., a first connection device at a forward axially end and a second connection device at an aft axially end).

With continued reference to FIG. 4, the connection device 205 may include a liner connection member 210 and a liner tile connection member 212. The liner connection member 210 may extend radially inward from an inner surface of the liner 202. For example, the liner connection member 210 has a radially extending liner connection member 210*a* and a circumferentially extending liner connection member 210*b*. The radially extending liner connection member 210*a* may extend radially inward from the inner surface of the liner 202. The circumferentially extending liner connection member 210*b* may extend circumferentially outward from an axis A bisecting the exemplary liner tile 204*a*.

The liner tile 204 has a liner body 207 that includes a main body 214 and the liner tile connection member 212. The liner tile connection member 212 may extend radially outward from an outer surface of the liner tile 204. For example, the liner tile connection member 212 has a radially extending liner tile connection member 212*a* and a circumferentially extending liner tile connection member 212*b*. The radially extending liner tile connection member 212*a* may extend radially outward from the outer surface of the liner tile 204. The circumferentially extending liner tile connection member 212*b* may extend circumferentially inward toward the axis A. A C-seal 220 may be placed between the circumferentially extending liner connection member 210*b* and the circumferentially extending liner tile connection member 212*b*. The C-seal 220 may accommodate thermal expansion of each of the liner 202 and the liner tile 204. Each of the liner tile connection member 210 and the liner tile connection member 212 may be L-shaped. Each of the liner tile connection member 210 and the liner tile connection member 212 may form a guide rail for the other component.

Figure 5:
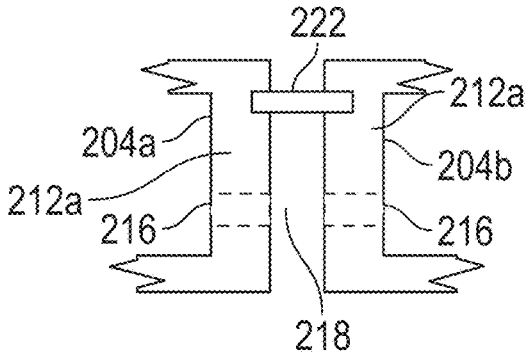
FIG. 5 shows a schematic, end view of a portion of the combustion liner assembly of FIG. 2, according to an embodiment of the present disclosure.

FIG. 5 is a schematic close-up detail 5 of two adjacent liner tiles 204. Each liner tile 204 may include one or more cooling holes 216 extending through the radially extending liner tile connection member 212*a*. Although only one end of the exemplary liner tile 204*a* and exemplary liner tile 204*b* are shown, one or more cooling holes 216 may be present on the circumferentially opposing end of the liner tile. The one or more cooling holes 216 may be staggered axially to allow purging of a gap 218 between adjacent liner tiles 204. A spring 222 may be included between the radially extending liner tile connection members 212*a* of the adjacent exemplary liner tile 204*a* and exemplary liner tile 204*b*. The spring 222 may be a leaf spring. The spring 222 may control the gap 218 between the adjacent liner tiles 204*a* and 204*b*. That is, the stiffness of the spring 222 may be selected to ensure a predetermined size of the gap 218. Thus, compression of the spring 222 by one or both of the liner tiles 204*a* and 204*b* (e.g. due to relative movement of the liner tiles, such as, for example, movement caused by thermal expansion) may alter the size of the gap 218, with the stiffness of the spring 222 controlling the degree to which the size of the gap 218 is changed and ensuring a predetermined size to allow for cooling.

Figure 6:
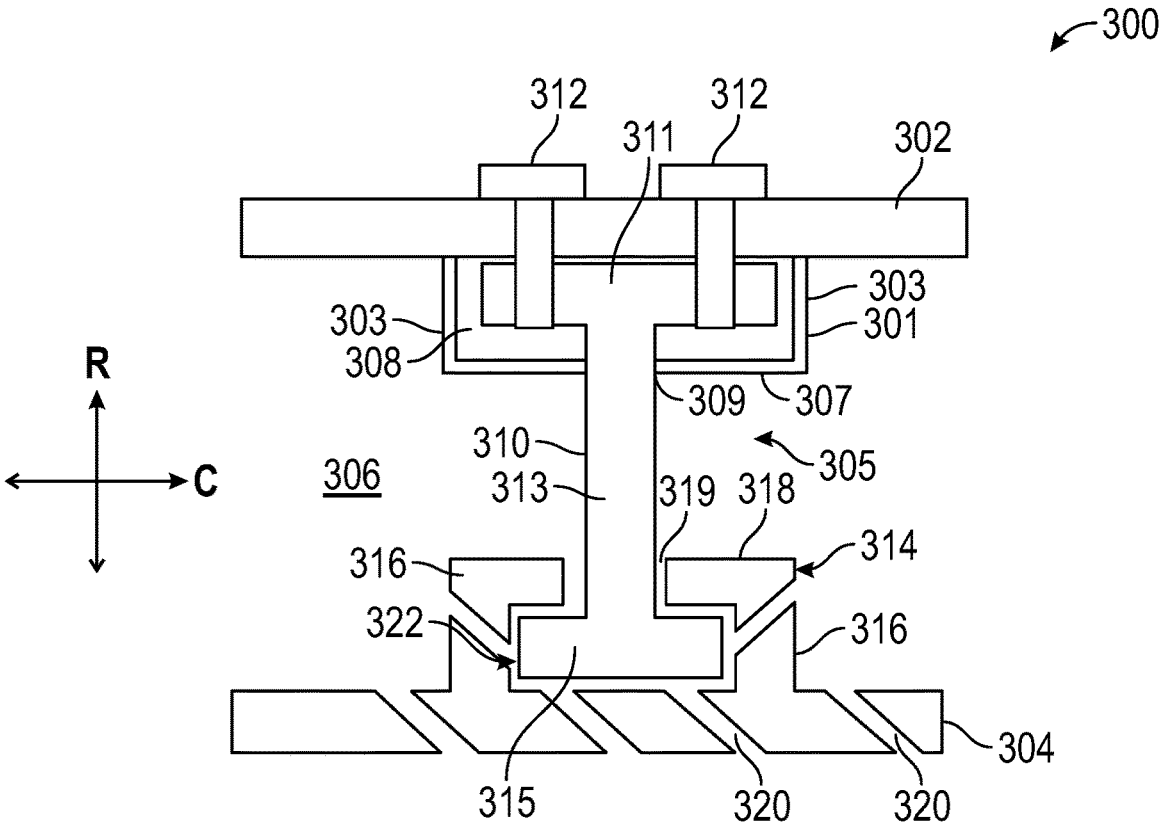
FIG. 6 shows a schematic, end view of a combustion liner assembly, according to an embodiment of the present disclosure.
Figure 7:
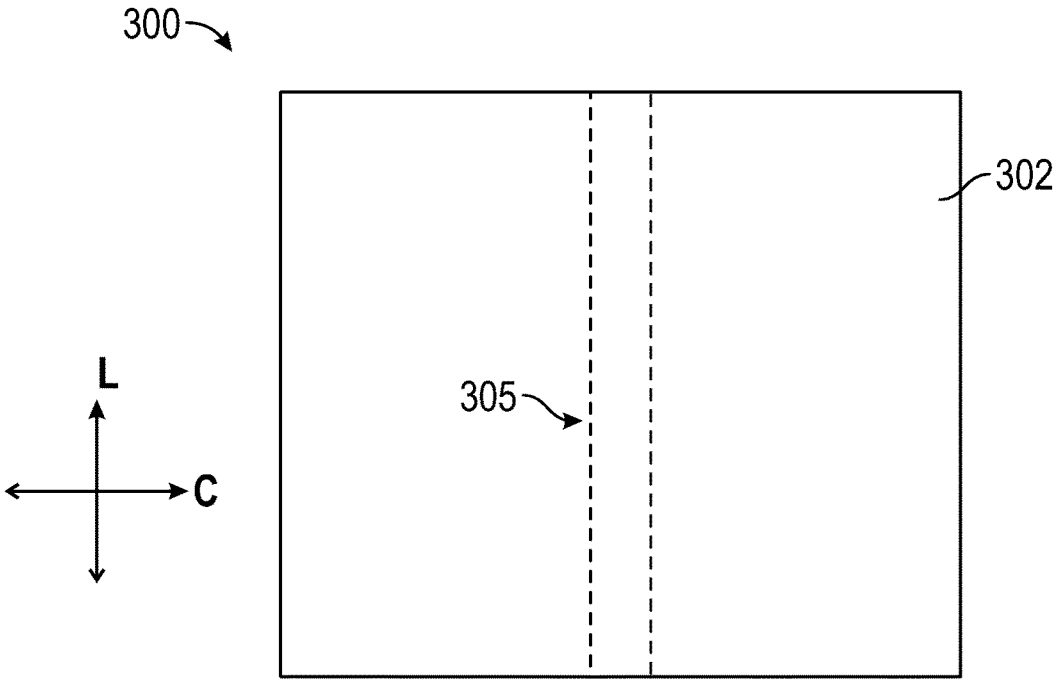
FIG. 7 shows a schematic, top view of the combustion liner assembly of FIG. 6, according to an embodiment of the present disclosure.

FIGS. 6 and 7 show an exemplary combustion liner assembly 300. The combustion liner assembly 300 may be provided in FIG. 1 as the outer liner 116, the inner liner 118, or both the outer liner 116 and the inner liner 118. The combustion liner assembly 300 may include a combustion liner 302, referred to herein as liner 302. The liner 302 may be the same as, or similar to, the liner 202 described with respect to FIG. 2. The combustion liner assembly 300 may include one or more combustion liner tiles 304, referred to herein, as liner tiles 304. The liner tiles 304 may be coupled on the side of the liner 302 exposed to the core primary combustion zone 114 (FIG. 1). The liner tiles 304 may be arranged on and coupled to the hot side of the liner 302, in a manner similar to, or the same as, liner tiles 204 described with respect to FIG. 2.

FIG. 6 shows a close-up end view of the combustion liner assembly 300. The combustion liner assembly 300 may include a connection device 305 that attaches and connects the liner 302 and the one or more liner tiles 304. That is, each of the liner tiles 304 is coupled at the connection device 305 to the liner 302. As shown in FIG. 6, each liner tile 304 is connected at a central location of the liner tile 304 with the connection device 305. Thus, there is a single connection device 305 for each liner tile 304. More connection devices 305 may, of course, be provided on each liner tile 304. Although shown at the central location of the liner tile 304, the connection device 305 may be offset from the central location (e.g., offset from a similar axis to axis A of FIG. 4). A gap or a space 306 may be located between a radially outer surface of each of the liner tiles 304 and a radially inner surface of the liner 302. The space 306 may be formed due to the connection device 305. Referring briefly to FIG. 7, the connection device 305 may extend along the axial length of the liner 302.

With continued reference to FIG. 6, the connection device 305 includes a liner guide channel 301, an I-member 310, a liner tile guide channel 314, and one or more fasteners 312. The liner guide channel 301 may also be referred to as a liner connection member 301. The liner tile guide channel 314 may also be referred to as a liner tile connection member 314.

The liner guide channel 301 may be formed of two radially extending liner connection members 303 connected together with a circumferentially extending liner connection member 307. A liner guide channel opening 309 is located in the circumferentially extending liner connection member 307. The I-member 310 is received within the liner guide channel opening 309, and within a liner channel space 308 located within the liner guide channel 301. For example, an upper circumferentially extending member 311 of the I-member 310 may be received within the liner channel space 308 and a radially extending member 313 may be received within the liner guide channel opening 309. The one or more fasteners 312 secure or attach the I-member 310 to the liner 302. For example, the one or more fasteners 312 may extend through the upper circumferentially extending member 311 to connect the I-member 310 to the liner 302.

The liner tile guide channel 314 may be formed of two radially extending liner tile connection members 316 connected together with a circumferentially extending liner tile connection member 318. A liner tile guide channel opening 319 is located in the circumferentially extending liner tile connection member 318. The I-member 310 is received within the liner tile guide channel opening 319 and a liner tile channel space 322 located within the liner tile guide channel 314. For example, a lower circumferentially extending member 315 of the I-member 310 may be received within the liner tile channel space 322 and the radially extending member 313 may be received within the liner tile guide channel opening 319. The liner tile guide channel 314 may include one or more cooling air holes 320.

The liner guide channel 301 may be formed separately from the liner 302 and secured thereto (e.g., by welding or brazing). Alternatively, the liner guide channel 301 may be integrally and unitarily formed with the liner 302. The liner guide channel 301 and the liner 302 may be formed of the same material. In some examples, both the liner guide channel 301 and the liner 302 are non-ceramic. In some examples, both the liner guide channel 301 and the liner 302 are formed of the same metal. The liner tile guide channel 314 may be formed integrally and unitarily with the liner tile 304. Although the fasteners 312 are radially extending fasteners, the fasteners are not directly exposed to hot gases on the hot side (e.g., the side of space 306 and liner tile 304) of the liner 302 due to the liner guide channel 301, which forms a protective layer for the fasteners 312. In this manner, the connection device 305 is free from (i.e., does not include) radial bolts directly exposed to hot gases on the hot side of the liner. The liner guide channel 306 protects the fasteners 312 from the hot gas within the combustion chamber.

In the examples of FIGS. 6 and 7, the connection device 305 may include a liner guide channel 301 that is a single piece shell. The liner tile 304 may include a closed guide rail that may be the liner tile guide channel 314. The separate I-member 310 is guided in between the liner guide channel 301 and the liner tile guide channel 314.

Figure 8:
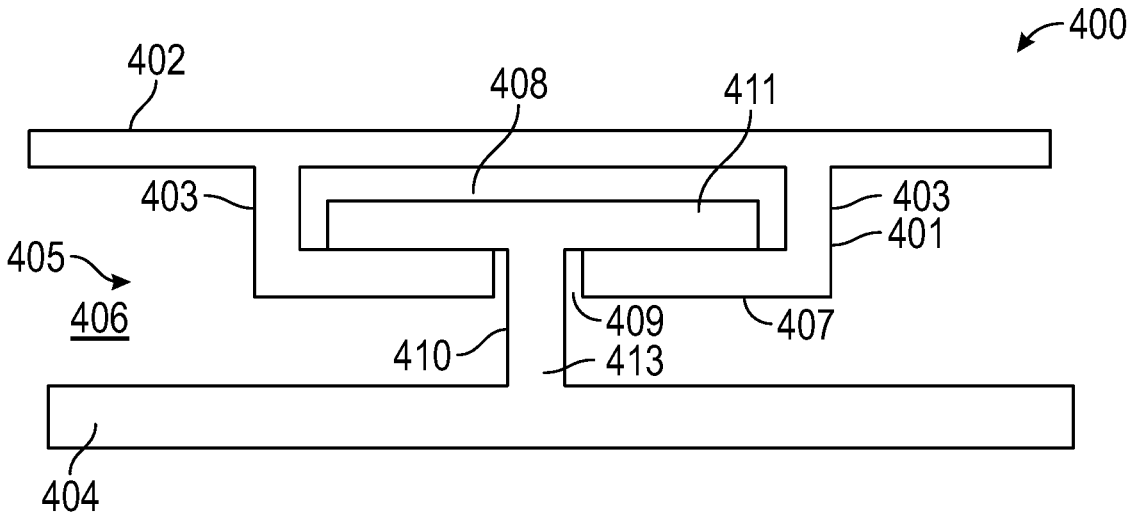
FIG. 8 shows a schematic, end view of a combustion liner assembly, according to an embodiment of the present disclosure.
Figure 9:
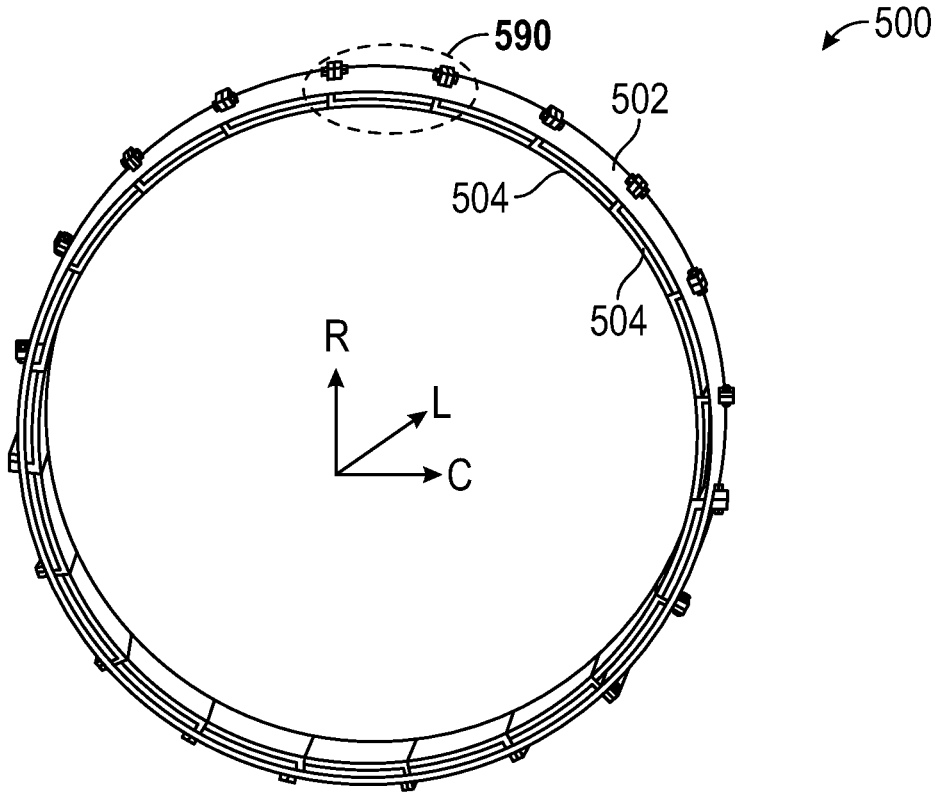
FIG. 9 shows a schematic, perspective view of a combustion liner assembly, according to an embodiment of the present disclosure.

FIG. 8 shows an exemplary combustion liner assembly 400. The combustion liner assembly 400 may be provided in FIG. 1 as the outer liner 116, the inner liner 118, or both the outer liner 116 and the inner liner 118. The combustion liner assembly 400 may include a combustion liner 402, referred to herein as liner 402. The liner 402 may be the same as, or similar to, the liner 202 described with respect to FIG. 2. The combustion liner assembly 400 may include one or more combustion liner tiles 404, referred to herein, as liner tiles 404. The liner tiles 404 may be coupled on the side of the liner 402 exposed to the core primary combustion zone 114 (FIG. 1). The liner tiles 404 may be arranged on and coupled to the hot side of the liner 402, in a manner similar to, or the same as, liner tiles 204 described with respect to FIG. 2.

The combustion liner assembly 400 may include a connection device 405 that attaches and connects the liner 402 and the one or more liner tiles 404. That is, each of the liner tiles 404 is coupled at the connection device 405 to the liner 402. Each liner tile 404 is connected at a central location of the liner tile 404 with the connection device 405. Thus, there is a single connection device 405 for each liner tile 404. However, more connection devices 405 may be provided on each liner tile 404. Although shown at the central location of the liner tile 404, the connection device 405 may be offset from the central location (e.g., offset from a similar axis to axis A of FIG. 4). A gap or a space 406 may be located between a radially outer surface of each of the liner tiles 404 and a radially inner surface of the liner 402. The space 406 may be formed due to the connection device 405.

With continued reference to FIG. 8, the connection device 405 includes a liner guide channel 401 and an I-member 410. The liner guide channel 401 may also be referred to as a liner connection member 401. The I-member 410 may also be referred to as a liner tile connection member 410.

The liner guide channel 401 may be formed of two radially extending liner connection members 403 connected together with a circumferentially extending liner connection member 407. A liner guide channel opening 409 is located in the circumferentially extending liner connection member 407. The I-member 410 is received within the liner guide channel opening 409 and within a liner channel space 408 located within the liner guide channel 401. For example, an upper circumferentially extending member 411 of the I-member 410 may be received within the liner channel space 408 and a radially extending member 413 may be received within the liner guide channel opening 409.

The I-member 410 may be integrally and unitary formed with the liner tile 404. In this manner, the I-member 410 extends directly from the liner tile 404. No liner tile guide channel is employed in the connection device 405. The connection device 405 further omits fasteners. The interaction between the upper circumferentially extending member 411 and the circumferentially extending liner connection member 407 provides the attaching and securing of the liner 402 and the liner tiles 404.

The liner guide channel 401 may be formed separately from the liner 402 and secured thereto (e.g., by welding or brazing). Alternatively, the liner guide channel 401 may be integrally and unitarily formed with the liner 402. A seal, not shown, may be placed underneath and/or on top of the upper circumferentially extending member 411. The seal may reduce, limit, or prevent vibration between the liner tile 404 and the liner 402.

In the examples of FIGS. 6 and 8, the I-member 310 and the I-member 410 allows for heat from within the combustion chamber, e.g., on the hot side of the liner, to dissipate or reduce before reaching the liner, thus, reducing the heat reaching the liner.

FIGS. 9 to 18 show an exemplary combustion liner assembly 500. The combustion liner assembly 500 may be provided in FIG. 1 as the outer liner 116, the inner liner 118, or both the outer liner 116 and the inner liner 118. The combustion liner assembly 500 may include a combustion liner 502, referred to herein as liner 502. The liner 502 may be the same as, or similar to, the liner 202 described with respect to FIG. 2. The combustion liner assembly 500 may include one or more combustion liner tiles 504, referred to herein, as liner tiles 504. The liner tiles 504 may be coupled on the side of the liner 502 exposed to the core primary combustion zone 114 (FIG. 1). The liner tiles 504 may be arranged on and coupled to the hot side of the liner 502, in a manner similar to, or the same as, liner tiles 504 described with respect to FIG. 2.

Figure 10:
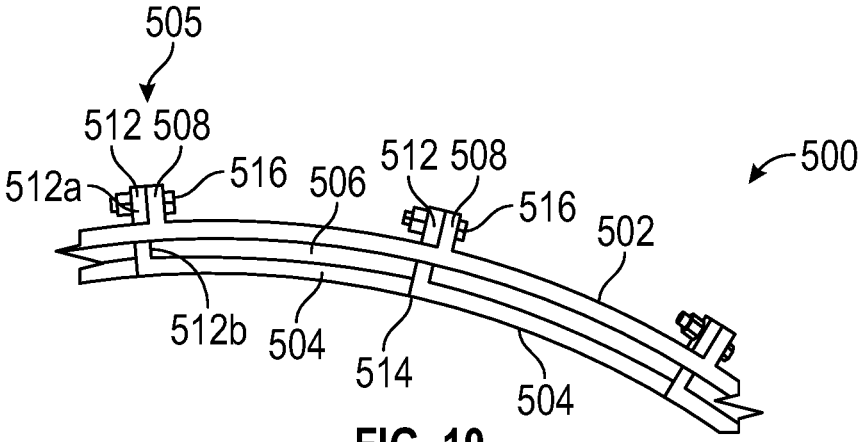
FIG. 10 shows a schematic, end view of a portion of the combustion liner assembly of FIG. 9, according to an embodiment of the present disclosure.
Figure 11:
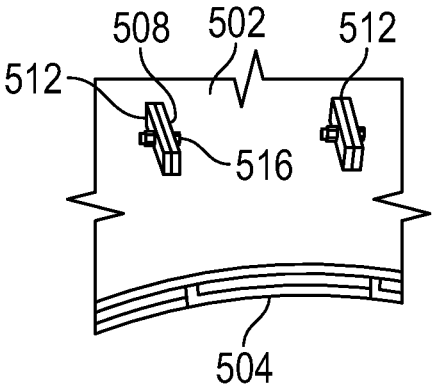
FIG. 11 shows a schematic, top view of a portion of the combustion liner assembly of FIG. 10, according to an embodiment of the present disclosure.
Figure 12:
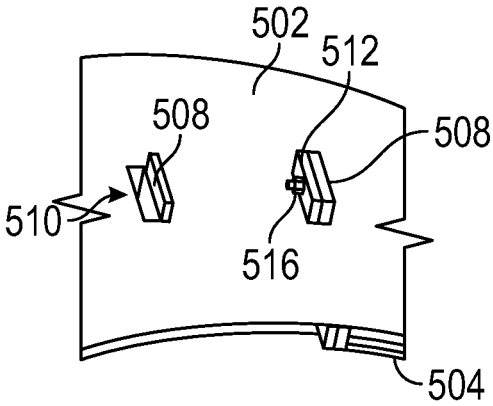
FIG. 12 shows a schematic, top view of a portion of the combustion liner assembly of FIG. 10, according to an embodiment of the present disclosure.

FIG. 10 shows a close-up view 590 (FIG. 9) and FIGS. 11 and 12 show close-up views of the combustion liner assembly 500. The combustion liner assembly 500 may include a connection device 505 that attaches and connects the liner 502 and the one or more liner tiles 504. That is, each of the liner tiles 504 is coupled at the connection device 505 to the liner 502. As shown in FIG. 10, each liner tile 504 is connected at one end of the liner tile 504 with the connection device 505. Although a single connection device 505 is provided for each liner tile 504, more may be provided. Although shown at one end of the liner tile 504, other locations are contemplated. A gap or a space 506 may be located between a radially outer surface of each of the liner tiles 504 and a radially inner surface of the liner 502. The space 506 may be formed due to the connection device 505.

The connection device 505 includes a liner connection member 508, a liner opening 510 (FIG. 12), a liner tile connection member 512, and one or more fasteners 516. The liner connection member 508 may be a radially extending liner connection member that extends radially outward from an outer surface (e.g., the cold side) of the liner 502. The liner opening 510 may extend through the liner 502 adjacent to the liner connection member 508. The liner tile connection member 512 may extend through the liner opening 510. For example, the liner tile connection member 512 may extend radially outward from an outer surface of the liner tile 504, through the liner opening 510 (e.g., through the liner opening 510 from the hot side of the liner 502 to the cold side of the liner 502) and continue radially past the outer surface of the liner 502. In this manner, the liner tile connection member 512 includes a first portion 512*a* that extends on the cold side of the liner 502 and a second portion 512*b* that extends on the hot side of the liner 502. The fastener 516 may extend through the liner connection member 508 and the first portion 512*a* of the liner tile connection member 512 to secure the aforementioned pieces together. The fastener 516 connects the liner connection member 508 and the liner tile connection member 512 together on the cold side of the liner 502. The fastener 516 extends in the circumferential direction. The fastener 516 extending in the circumferential direction reduces stress on the fastener 516 and the liner 502 as compared to radially extending fasteners. That is, with a radially extending fastener coupling the liner tile and the liner, the differences in thermal expansion of the components being coupled (e.g., the liner formed of metal and the liner tile formed of ceramic, for example), the exposure to hot gases, or both, can place stress on a radially extending bolt causing the bolt to wear or fail. By orienting the fastener 516 in the circumferential direction (or in an axial direction, as described further herein), the stresses caused by different thermal expansions of the components being coupled are reduced or eliminated and thus, the lower stresses on the fastener are experienced.

With reference to FIG. 10, a liner tile end 514 of the liner tile 504 may be located adjacent to the liner tile connection member 512 of another liner tile 504. The liner tile end 514 may be free to move with respect to the other liner tile 504. That is, the liner tile end 514 of a first liner tile 504 is not connected to the liner tile connection member 512 and/or the liner tile of a second liner tile 504.

FIGS. 13 to 18 show variations of the combustion liner assembly 500.

Figure 13:
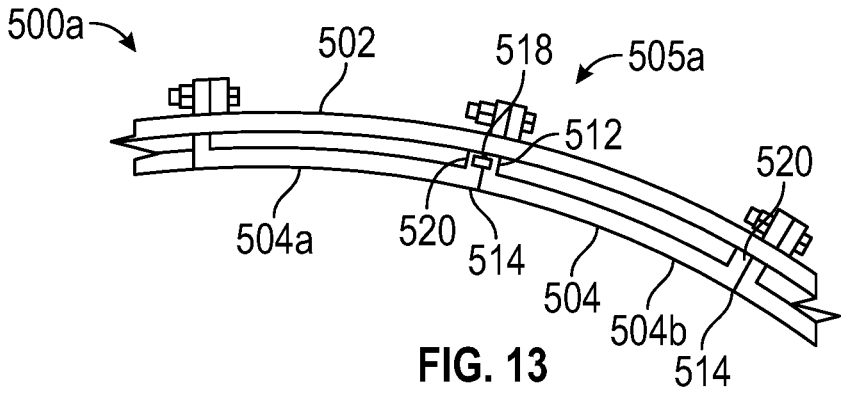
FIG. 13 shows a schematic, end view of a portion of a combustion liner assembly, according to an embodiment of the present disclosure.

In FIG. 13, a combustion liner assembly 500*a* includes a connection device 505*a* that attaches and connects the liner 502 and the one or more tiles 504. The liner tile 504 includes an end member 520 extending radially outward from the liner tile end 514. The end member 520 of a first liner tile 504*a* may be adjacent to the liner tile connection member 512 of a second liner tile 504*b*. A seal 518 may be located between the liner tile connection member 512 of the second liner tile 504*b* and the end member 520 of the first liner tile 504*a*.

Figure 14:
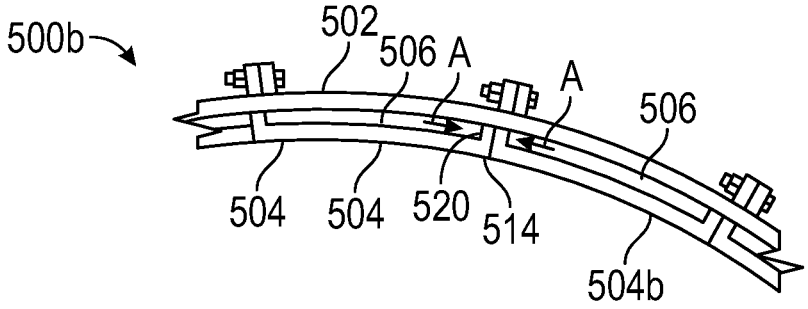
FIG. 14 shows a schematic, end view of a portion of a combustion liner assembly, according to an embodiment of the present disclosure.
Figure 15:
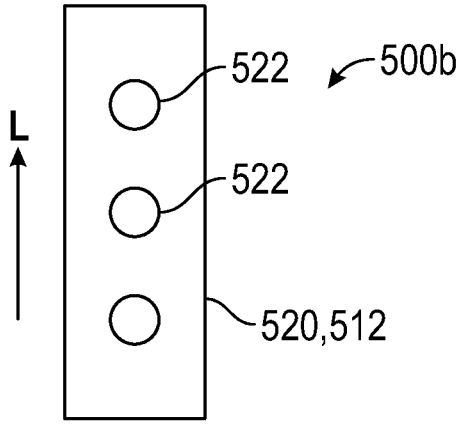
FIG. 15 shows a schematic, end view of a portion of a liner tile of a combustion liner assembly, according to an embodiment of the present disclosure.

In FIG. 14, the combustion liner assembly 500*b* may be the same as, or similar to, the combustion liner assembly 500*a* described with respect to FIG. 13. In addition to the seal 518, or as an alternative to the seal 518, the combustion liner assembly 500*b* may include one or more cooling holes 522 (FIG. 15) in each of the end member 520 and the liner tile connection member 512. The one or more cooling holes 522 may be aligned or staggered between adjacent liner tiles 504. The one or more cooling holes 522 may be located in the end member 520, the liner tile connection member 512, or both. As shown in FIG. 14, the one or more cooling holes 522 may allow an air flow A to flow within the space 506 between the liner 502 and the liner tiles 504.

Figure 16:
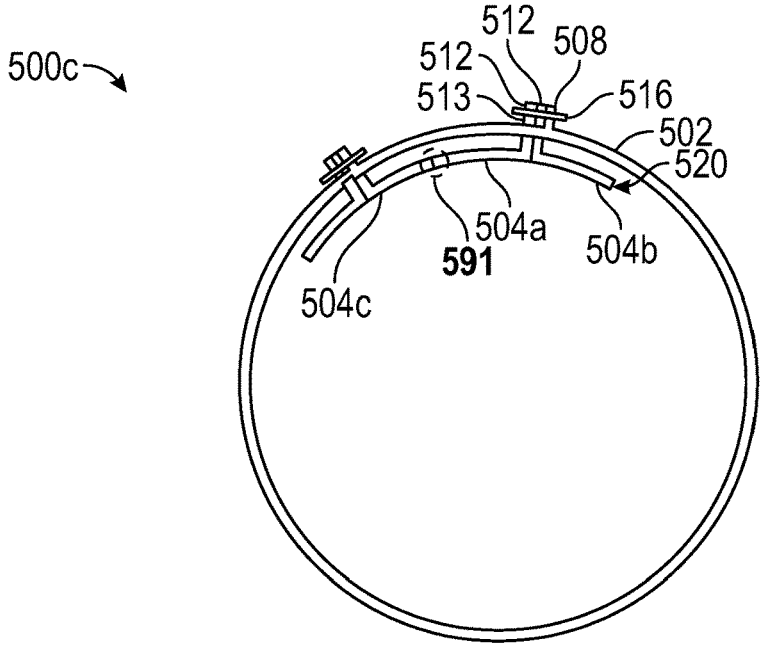
FIG. 16 shows a schematic view of a fastener of a combustion liner assembly, according to an embodiment of the present disclosure.
Figure 17:
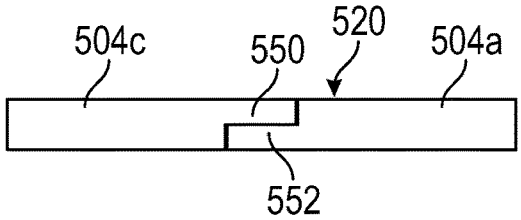
FIG. 17 shows a schematic, end view of a combustion liner assembly, according to an embodiment of the present disclosure.

Referring to FIGS. 16 and 17, the combustion liner assembly 500*c* may be the same as, or similar to, the combustion liner assembly 500*a* described with respect to FIG. 13 and/or the combustion liner assembly 500*b* described with respect to FIG. 14. In FIG. 16, the liner tile connection member 512 of adjacent liner tiles (e.g., liner tile 504*a* and liner tile 504*b*) may abut one another. The fastener 516 may extend through the liner connection member 508, the liner tile connection member 512 of the liner tile 504*b*, and the liner tile connection member 512 of the liner tile 504*a*. In this manner, both the liner tile connection members 512 are connected with the liner connection member 508 on the cold side of the liner 502. Since the liner tile connection members 512 abut one another, the ends 520 of the adjacent liner tiles 504 and 504*b* may extend circumferentially away from one another. Thus, the liner tile connection member 512 of the liner tile 504*a* may abut the liner tile 504*b* while the end 520 may abut the liner tile 504*c*. The close-up view 591 (FIG. 16) is shown in FIG. 17, the ends 520 of the adjacent liner tiles (e.g., liner tile 504*a* and liner tile 504*c*) may be abutting in a manner that allows for relative movement, such as a shiplap arrangement. In the shiplap arrangement, an extension 552 of the liner tile 504*a* may overlap an extension 550 of the liner tile 504*c* in a circumferentially direction around the liner 502. Other connections are contemplated, such as the connections shown and described below with respect to FIGS. 30A to 30D.

Figure 18:
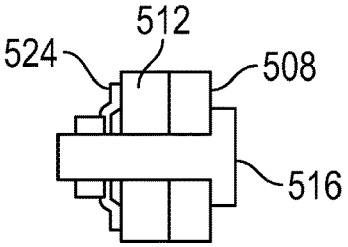
FIG. 18 shows a schematic, end view of a portion of a liner tile of a combustion liner assembly, according to an embodiment of the present disclosure.

FIG. 18 shows an exemplary fastener 516 for coupling the liner connection member 508 and the liner tile connection member 512. The fastener 516 may include a spring 524. Any of the features presented in the combustion liner assemblies 500, 500*a*, 500*b*, and 500*c* may be included in any of the other combustion liner assemblies 500, 500*a*, 500*b*, and 500*c*. The spring 524 assists in accommodating the different thermal expansions of the liner 502 and the liner tile 504 and assists in reducing the stresses acting on the fasteners 516.

Figure 19:
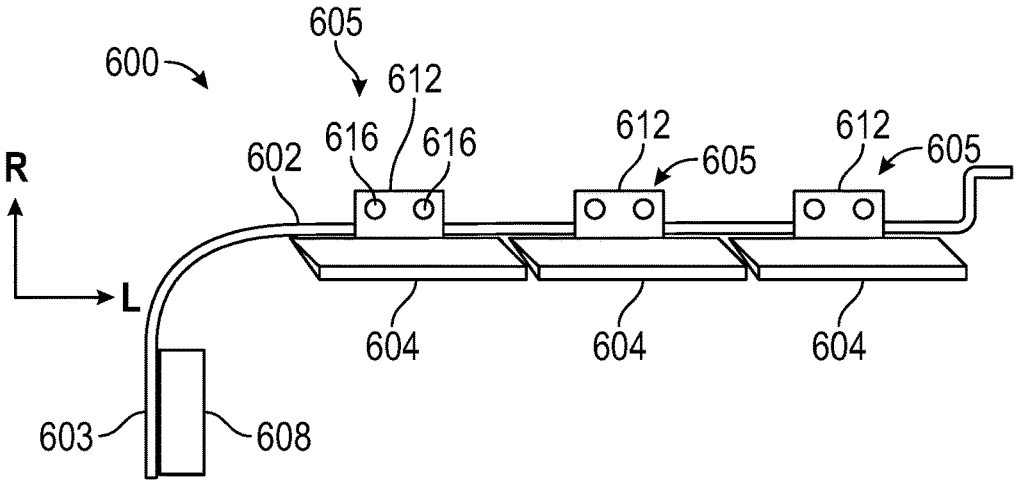
FIG. 19 shows a schematic view of a portion of a combustion liner assembly, according to an embodiment of the present disclosure.
Figure 20:
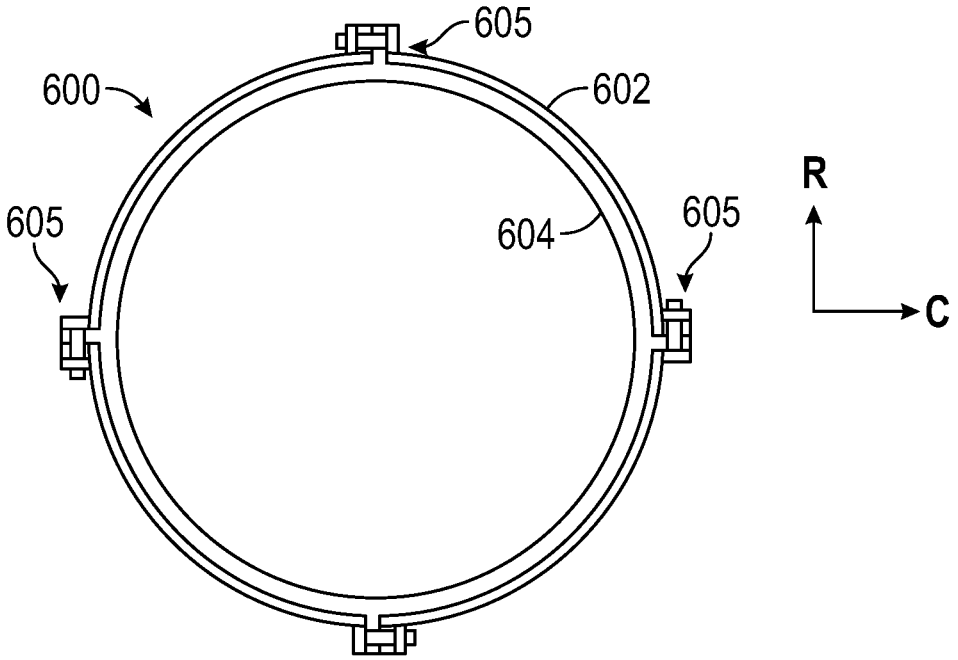
FIG. 20 shows a schematic, end view of a combustion liner assembly, according to an embodiment of the present disclosure.

FIGS. 19 to 24 show a combustion liner assembly 600 and variations thereof. With reference to FIG. 19, the combustion liner assembly 600 may include a liner 602, a dome 603, and a deflector 601. Although not shown in other embodiments, the dome 603 and deflector 601 may be incorporated into any of the combustion liner assemblies described herein. As in other examples, the combustion liner assembly 600 may include one or more liner tiles 604 attached to the liner 602 with connection devices 605. The one or more liner tiles 604 may be attached to the liner 602 on a cold side of the liner 602 with one or more fasteners 616 extending through a liner tile connection member 612, as will be described with respect to FIGS. 21 to 24. The one or more liner tiles 604 may be arranged in series along the axially direction L of the combustion liner 602 (FIG. 19) and along the circumferential direction C of the combustion liner 602 (FIG. 20). As shown in FIG. 20, the connection devices 605 may be placed circumferentially around the liner 602. Although four connection devices 605 are shown, more or fewer may be provided.

FIGS. 21 to 24 illustrate various alternative combustion liner assemblies for employing in the combustion liner assembly 600 of FIGS. 19 and 20.

Figure 21:
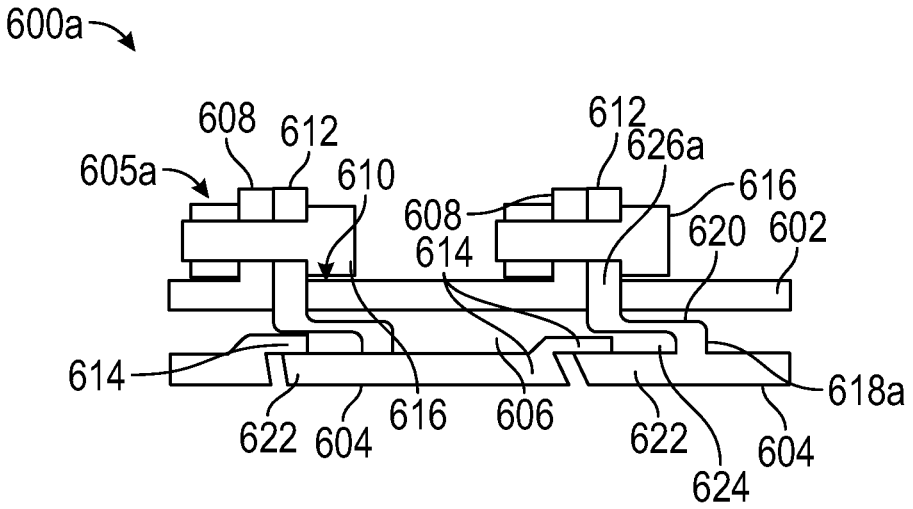
FIG. 21 shows a schematic, end view of a portion of the combustion liner assembly of FIG. 20, according to an embodiment of the present disclosure.

FIG. 21 shows an exemplary combustion liner assembly 600*a*. The combustion liner assembly 600*a* includes a liner tile 604 and a liner 602 connected together with a connection device 605*a*. As shown in FIG. 21, each liner tile 604 is connected at one end of the liner tile 604 with the connection device 605*a*. Although a single connection device 605*a* for each liner tile 604 is depicted, more may be provided. Although shown at one end of the liner tile 604, other locations are contemplated. A gap or a space 606 may be located between a radially outer surface of each of the liner tiles 604 and a radially inner surface of the liner 602. The space 606 may be formed due to the connection device 605*a*.

The connection device 605*a* includes a liner connection member 608, a liner opening 610, a liner tile connection member 612, and one or more fasteners 616. The liner connection member 608 may be a radially extending liner connection member that extends radially outward from an outer surface (e.g., the cold side) of the liner 602. The liner opening 610 may extend through the liner 602 adjacent to the liner connection member 608. The liner tile connection member 612 may extend through the liner opening 610. For example, the liner tile connection member 612 may extend radially outward from an outer surface of the liner tile 604, through the liner opening 610 (e.g., through the liner opening 610 from the hot side of the liner 602 to the cold side of the liner 602) and continue radially past the outer surface of the liner 602. In this manner, the liner tile connection member 612 includes a first portion that extends on the cold side of the liner 602 and a second portion that extends on the hot side of the liner 602. The fastener 616 may extend through the liner connection member 608 and the first portion of the liner tile connection member 612 to secure the aforementioned pieces together. The fastener 616 connects the liner connection member 608 and the liner tile connection member 612 together on the cold side of the liner 602. The liner tile connection member 612 may include a first radially extending portion 618*a*, a circumferentially extending portion 620*a*, and a second radially extending portion 626*a*.

A first liner tile end 614 of the liner tile 604 may be located adjacent to the liner tile connection member 612 of another liner tile 604. The first liner tile end 614 may be arranged in an overlapping, shiplap type connection with a second liner tile end 622 of the adjacent liner tile 604. That is, the first liner tile end 614 may extend within an opening 624 located between the liner tile connection member 612 and the second liner tile end 622, both of an adjacent liner tile 604. The first liner tile end 614 may be free to move with respect to the second liner tile end 622 of the adjacent liner tile 604. That is, the first liner tile end 614 of a first liner tile 604 is not fixedly connected to the second liner tile end 622 and/or the adjacent liner tile 604.

Figure 22:
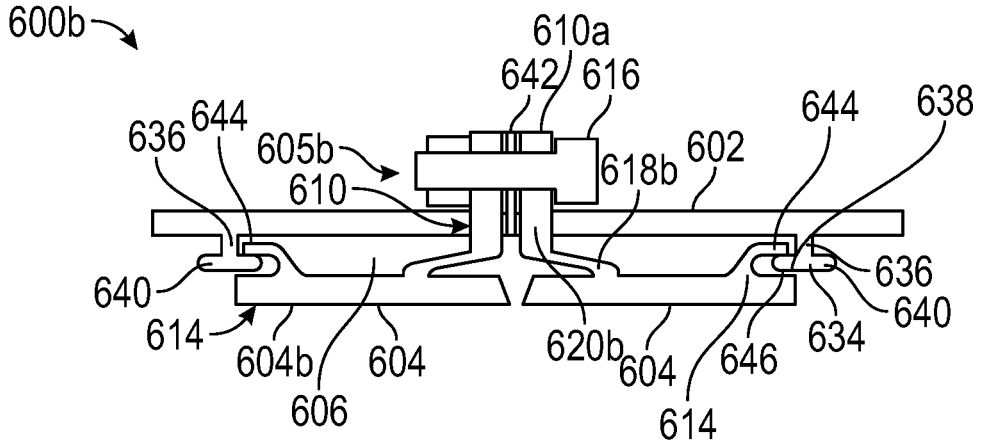
FIG. 22 shows a schematic, end view of a portion of the combustion liner assembly of FIG. 20, according to an embodiment of the present disclosure.

FIG. 22 shows an exemplary combustion liner assembly 600*b*. The combustion liner assembly 600*b* includes a liner tile 604 and a liner 602 connected together with a connection device 605*b*. As shown in FIG. 22, each liner tile 604 is connected at one end of the liner tile 604 with the connection device 605*b*. Although a single connection device 605*b* for each liner tile 604 is depicted, more may be provided. Although shown at one end of the liner tile 604, other locations are contemplated. A gap or a space 606 may be located between a radially outer surface of each of the liner tiles 604 and a radially inner surface of the liner 602. The space 606 may be formed due to the connection device 605*b*.

The connection device 605*b* includes a liner opening 610, a first liner tile connection member 612*a*, a second liner tile connection member 612*b*, and one or more fasteners 616, and a seal 642. The liner opening 610 may extend through the liner 602. The first liner tile connection member 612*a* and the second liner tile connection member 612*b* may extend through the liner opening 610. For example, each of the first liner tile connection member 612*a* and the second liner tile connection member 612*b* may extend radially outward from an outer surface of the liner tile 604, through the liner opening 610 (e.g., through the liner opening 610 from the hot side of the liner 602 to the cold side of the liner 602) and continue radially past the outer surface of the liner 602. In this manner, each of the first liner tile connection member 612*a* and the second liner tile connection member 612*b* includes a first portion that extends on the cold side of the liner 602 and a second portion that extends on the hot side of the liner 602. The fastener 616 may extend through the first portion of the first liner tile connection member 612*a*, the first portion of the second liner tile connection member 612*b*, and the seal 642 to secure the aforementioned pieces together on the cold side of the liner 602. Each of the first liner tile connection member 612*a* and the second liner tile connection member 612*b* may include a radially and circumferentially extending portion 618*b* and a radially extending portion 620*b*.

Referring to FIG. 22, a liner extension member 636 may extend radially inward from an inner surface of the liner 602. The liner extension member 636 may extend radially inward on the hot side of the liner 602. The liner extension member 636 may have a circumferentially extending portion 634 with a first end 638 and a second end 640. The liner tile 604 may include a liner tile end 614 adjacent to the liner extension member 636. A lip 644 of the liner tile end 614 may interface with one of the first end 638 or the second end 640 such that the first end 638 or the second end 640 is received within a recess 646 of the liner tile end 614. With this arrangement, the liner tile end 614 may be free to move with respect to the liner extension member 636. That is, the liner tile end 614 is not fixedly connected to the liner 602.

Figure 23:
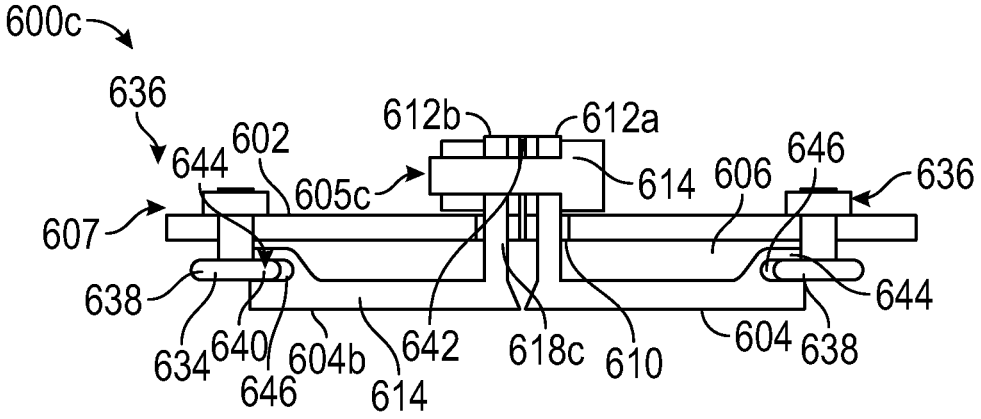
FIG. 23 shows a schematic, end view of a portion of the combustion liner assembly of FIG. 20, according to an embodiment of the present disclosure.

FIG. 23 shows an exemplary combustion liner assembly 600*c*. The combustion liner assembly 600*c* includes a liner tile 604 and a liner 602 connected together with a connection device 605*c*. As shown in FIG. 23, each liner tile 604 is connected at one end of the liner tile 604 with the connection device 605*c*. Although a single connection device 605*c* for each liner tile 604 is depicted, more may be provided. Although shown at one end of the liner tile 604, other locations are contemplated. A gap or a space 606 may be located between a radially outer surface of each of the liner tiles 604 and a radially inner surface of the liner 602. The space 606 may be formed due to the connection device 605*c*.

The connection device 605*c* includes a liner opening 610, a first liner tile connection member 612*a*, a second liner tile connection member 612*b*, and one or more fasteners 616, and a seal 642. The liner opening 610 may extend through the liner 602. The first liner tile connection member 612*a* and the second liner tile connection member 612*b* may extend through the liner opening 610. For example, each of the first liner tile connection member 612*a* and the second liner tile connection member 612*b* may extend radially outward from an outer surface of the liner tile 604, through the liner opening 610 (e.g., through the liner opening 610 from the hot side of the liner 602 to the cold side of the liner 602) and continue radially past the outer surface of the liner 602. In this manner, each of the first liner tile connection member 612*a* and the second liner tile connection member 612*b* includes a first portion that extends on the cold side of the liner 602 and a second portion that extends on the hot side of the liner 602. The fastener 616 may extend through the first portion of the first liner tile connection member 612*a*, the first portion of the second liner tile connection member 612*b*, and the seal 642 to secure the aforementioned pieces together on the cold side of the liner 602. Each of the first liner tile connection member 612*a* and the second liner tile connection member 612*b* may include a radially extending portion 618*c*.

Referring to FIG. 23, a liner extension member 636 may extend radially inward from an inner surface of the liner 602. The liner extension member 636 may extend radially inward on the hot side of the liner 602. The liner extension member 636 may have a circumferentially extending portion 634 with a first end 638 and a second end 640. The liner tile 604 may include a liner tile end 614 adjacent the liner extension member 636. A lip 644 of the liner tile end 614 may interface with one of the first end 638 or the second end 640 such that the first end 638 or the second end 640 is received within a recess 646 of the liner tile end 614. With this arrangement, the liner tile end 614 may be free to move with respect to the liner extension member 636. That is, the liner tile end 614 is not fixedly connected to the liner 602. The liner extension member 636 may be a fastener. In examples when the liner extension member 636 is a fastener, the fastener does not fixedly connect the liner 602 to the liner tiles 604 such that there is no relative motion therebetween. Instead, the fastener provides extending portions for the liner tile 604 to overlap therewith.

Figure 24:
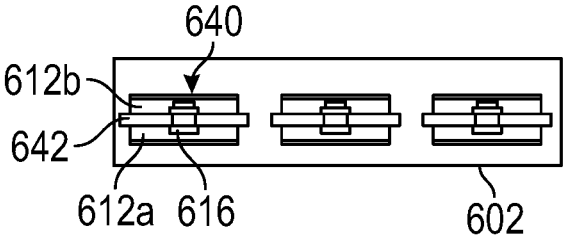
FIG. 24 shows a schematic, top view of a portion of a combustion liner assembly, according to an embodiment of the present disclosure.

FIG. 24 shows a top view representative of both of the combustion liner assembly 600*b* described with respect to FIG. 22 and the combustion liner assembly 600*c* described with respect to FIG. 23. As shown, the first liner tile connection member 612*a* and the second liner tile connection member 612*b* may extend through the liner opening 610 and be coupled together on either side of a seal 642. The connection may be made with the fastener 616.

In the examples of FIGS. 19 to 24, the liner tiles may have inclined ends in the circumferential direction to assist in cooling. The fasteners 616 are circumferentially and tangentially extending bolts, extending in the circumferential direction of the liner 602. In the examples of FIGS. 19 to 24, the liner tiles 604 may be circumferential segments connected with the liner through tangential bolts. The liner tiles 604 may be a single component in the axial direction and tiled in the circumferential direction. In some examples, the liner tiles 604 may be tiled in the circumferential and axial directions. In the examples of FIGS. 19 to 24, one circumferential end of the liner tiles 604 are bolted or fixed and the other, opposing circumferential end, is free. That is, relative movement is permitted.

Figure 25:
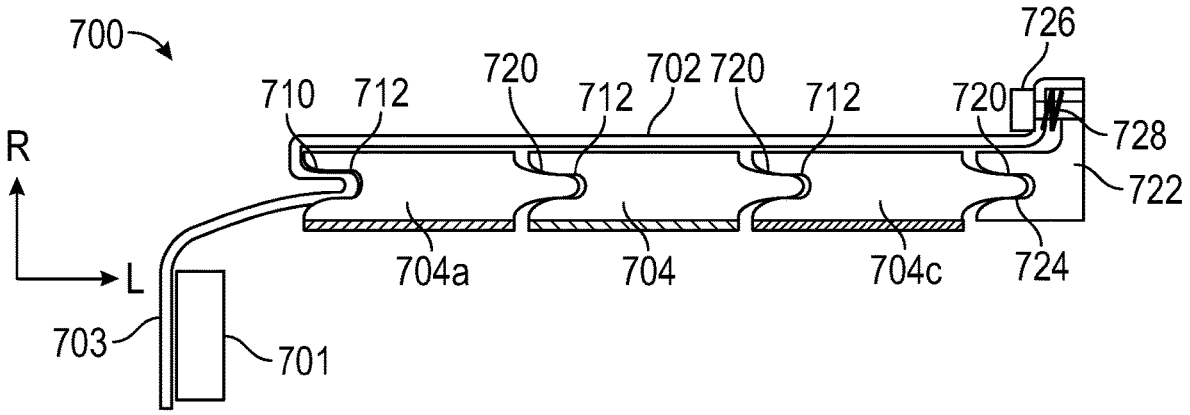
FIG. 25 shows a schematic view of a portion of a combustion liner assembly, according to an embodiment of the present disclosure.

FIG. 25 shows a combustion liner assembly 700. The combustion liner assembly 700 may include a liner 702, a dome 703, and a deflector 701. As in other examples, the combustion liner assembly 700 may include one or more liner tiles 704 attached to the liner 702 with connection devices (not shown). The connection devices may be any of the connection devices described herein. The one or more liner tiles 704 may be arranged in series along the axially direction L of the liner 702 and along the circumferential direction C of the liner 702 (e.g., in a manner similar to the manner described with respect to FIG. 2 and/or FIG. 20). The liner may include a liner protrusion 710. The liner protrusion 710 may be received within a liner tile recess 712 of a forwardmost liner tile 704*a*. Each liner tile 704 may include a liner tile protrusion 720 and a liner tile recess 712. The liner tile protrusion 720 may be received within the liner tile recess 712 of an adjacent liner tile 704. The liner tile protrusion 720 of an aftmost liner tile 704*c* may be received within a recess 724 of an end block 722. The end block 722 may be coupled to the liner 702 with a fastener 726 and a spring 728. The spring 728 may allow for axial movement of the liner tiles 704.

Figure 26:
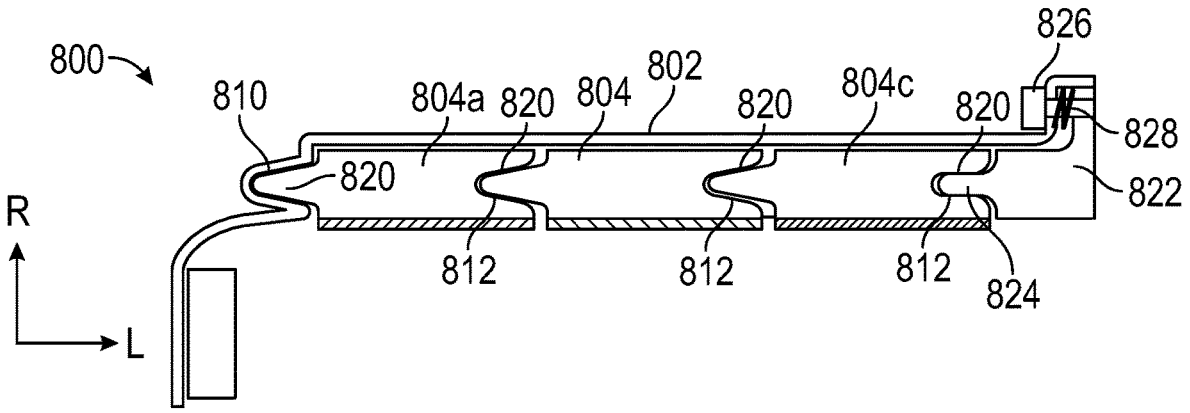
FIG. 26 shows a schematic view of a portion of a combustion liner assembly, according to an embodiment of the present disclosure.

FIG. 26 shows a combustion liner assembly 800. The combustion liner assembly 800 is substantially the same as the combustion liner assembly 700 with the protrusions and recesses reversed. That is, the liner may include a liner recess 810. The liner recess 810 may receive a liner tile protrusion 820 of a forwardmost liner tile 804*a*. Each liner tile 804 may include a liner tile protrusion 820 and a liner tile recess 812. The liner tile recess 812 may receive a liner tile protrusion 820 of an adjacent liner tile 804. The liner tile recess 812 of an aftmost liner tile 804*c* may receive a protrusion 824 of an end block 822. The end block 822 may be coupled to the liner 802 with a fastener 826 and a spring 828. The spring 828 may allow for axial movement of the liner tiles 804.

Figure 27:
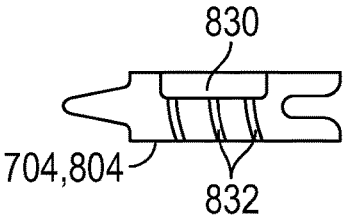
FIG. 27 shows a schematic view of a liner tile of a combustion liner assembly, according to an embodiment of the present disclosure.

Referring to FIG. 27, the liner tiles 704 or the liner tiles 804 may include a cavity 830 and cooling holes 832. In the examples of FIGS. 26 and 27, each of the liner tiles 704 and the liner tiles 804 may be a single three hundred sixty degrees annular component. The singular, annular liner tiles may be stacked axially along the axial length of the liner 702 such that the liner tiles are tiled axially. In some examples, the liner tiles may be tiled circumferentially and axially. The spring 728 and the spring 8282 may accommodate the thermal expansion of the liner tiles 704 and the liner tiles 804, respectively. A seal may be placed at the connection between the protrusion and the recess.

Figure 28:
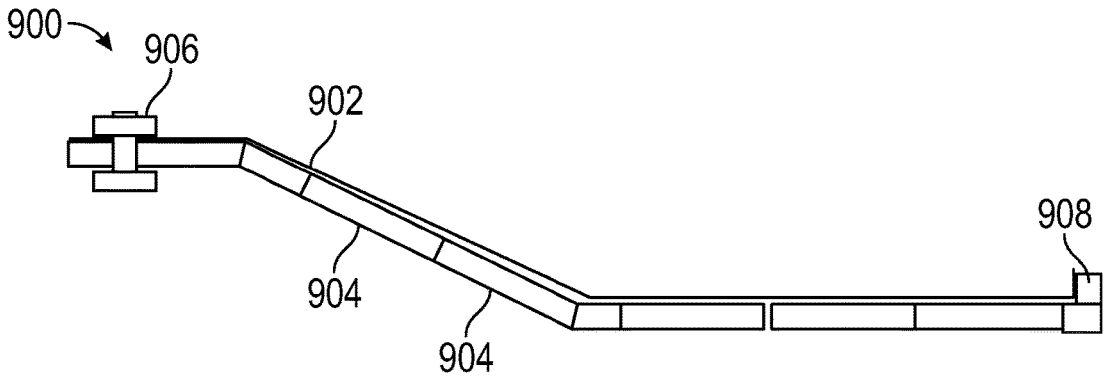
FIG. 28 shows a schematic, side view of a combustion liner assembly, according to an embodiment of the present disclosure.

FIG. 28 shows an exemplary combustion liner assembly 900. The combustion liner assembly 900 may include any of the combustion liner assemblies, and any components thereof, that are described herein. The combustion liner assembly 900 shows an exemplary shape that a combustion liner assembly of the present disclosure may take. The liner tiles 904 may be arranged serially along the axial length of the liner 902 on the hot side of the liner 902. The forward most liner tile may be fixed to the liner 902 at point 906 and the aftmost liner tile may be fixed to the liner 902 at point 908. The points 906 and 908 may be any of the connections described with respect to FIGS. 25 and 26 and/or any of the connection devices described with respect to FIGS. 2 to 24.

Figure 29:
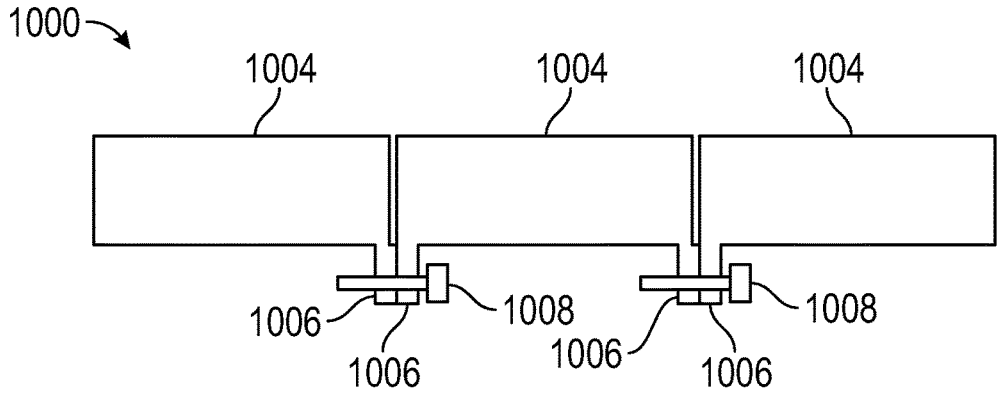
FIG. 29 shows a schematic, end view of liner tiles of a combustion liner assembly, according to an embodiment of the present disclosure.

FIG. 29 shows an exemplary liner tile assembly 1000 that may be employed in any of the combustion liner assemblies described herein. The liner tile assembly 1000 may include a plurality of liner tiles 1004 coupled in serial arrangement in the axial direction. The liner tiles 1004 may each include an extension 1006 on opposing sides of the liner tile 1004. The extensions 1006 of adjacent axial liner tiles 1004 may be connected together with a fastener 1008. The connection device of FIG. 29 may result in a bolted/gang channel design on the cold side of the liner.

Figure 30A:
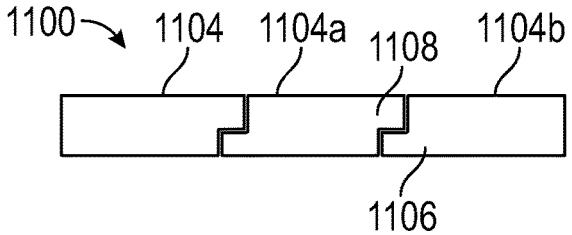
FIG. 30A shows a schematic, end view of liner tiles of a combustion liner assembly, according to an embodiment of the present disclosure.
Figure 30B:
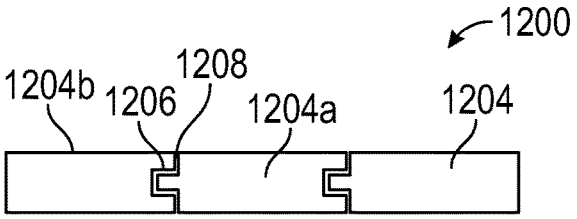
FIG. 30B shows a schematic, end view of liner tiles of a combustion liner assembly, according to an embodiment of the present disclosure.
Figure 30C:
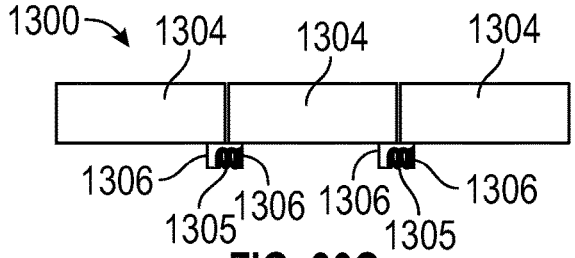
FIG. 30C shows a schematic, end view of liner tiles of a combustion liner assembly, according to an embodiment of the present disclosure.
Figure 30D:
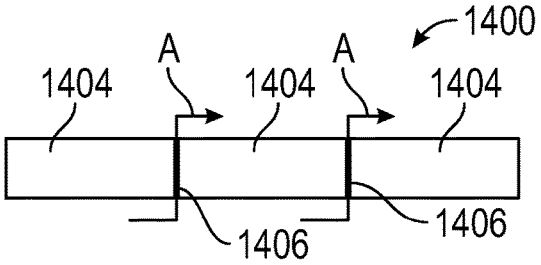
FIG. 30D shows a schematic, end view of liner tiles of a combustion liner assembly, according to an embodiment of the present disclosure.

FIGS. 30A to 30D illustrate exemplary axial connections between adjacent liner tiles (e.g., connections for providing between adjacent liner tiles extending along the axial length of the liner). The connections of FIGS. 30A to 30D may allow for relative movement between adjacent liner tiles. For example, in the liner tile assembly 1100 of FIG. 30A, the liner tiles 1104 may be a shiplap arrangement, similar to the arrangement described with respect to FIGS. 17 and 21. That is, an extension 1108 of a first liner tile 1104*a* may overlap an extension 1106 of a second liner tile 1104*b*. In FIG. 30B, the liner tile assembly 1200 may have liner tiles 1204 with an interference fit such that an extension 1208 of a first liner tile 1204*a* is received within a recess 1206 of a second liner tile 1204*b*. In the aspect of FIG. 30C, the liner tile assembly 1300 may have an arrangement similar to that shown in FIG. 29, with the addition of a W-seal 1305 between adjacent extensions 1306 of adjacent liner tiles 1304. In the aspect of FIG. 30D, the liner tile assembly 1400 has connections between adjacent liner tiles 1404 that provide a cooling passage 1406 is provided between adjacent liner tiles 1404 to allow a flow of air A to flow through the cooling passage 1406.

Although described as axial connections, the connections of FIGS. 29 and 30A to 30D may be provided in the circumferentially direction between adjacent liner tiles.

Figure 31:
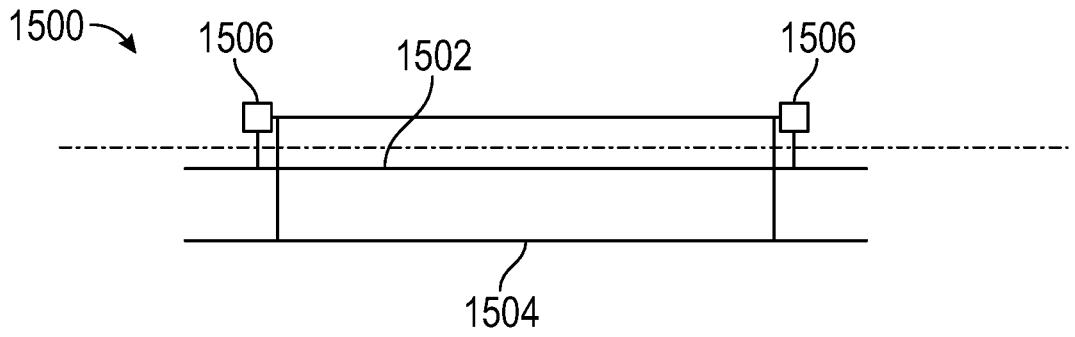
FIG. 31 shows a schematic, side view of a combustion liner assembly, according to an embodiment of the present disclosure.
Figure 32:
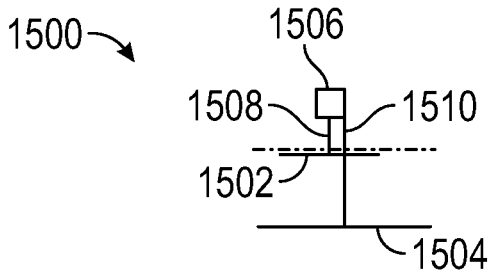
FIG. 32 shows a schematic, side view of a portion a combustion liner assembly, according to an embodiment of the present disclosure.
Figure 33:
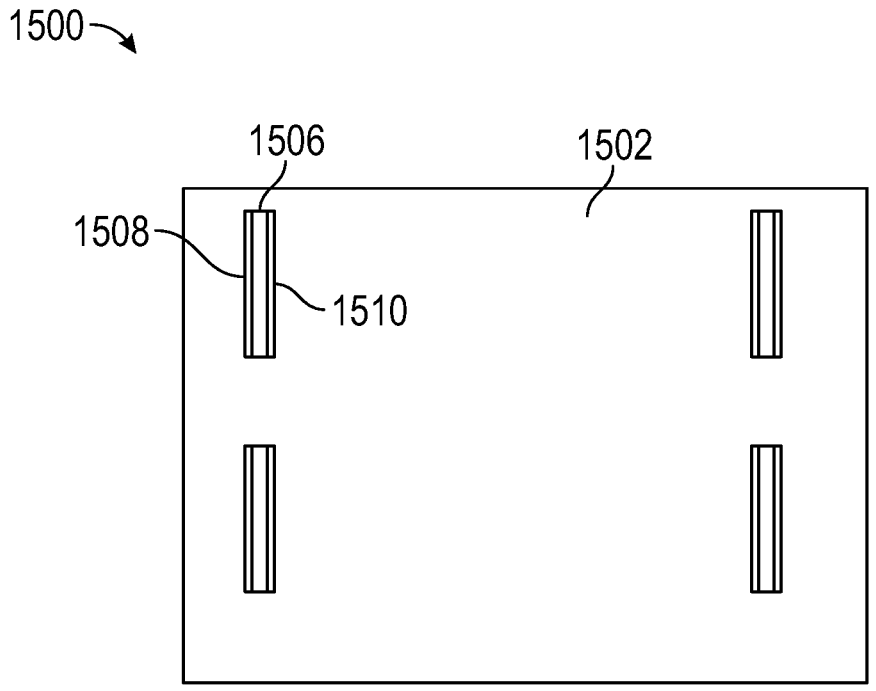
FIG. 33 shows a schematic, top view of a combustion liner assembly, according to an embodiment of the present disclosure.

FIGS. 31 and 32 also illustrate exemplary axial connections between adjacent liner tiles. In the examples of FIGS. 31 and 32, the combustion liner assembly 1500 may include a fixed connection 1506 that couples the liner 1502 to the liner tile 1504. The fixed connection 1506 may be a braze, spot weld, or axial bolt that extends in the axial direction of the combustion liner assembly 1500. FIG. 32 shows a close-up view of the combustion liner assembly 1500 showing the liner extension 1508 of the liner 1502 and the liner tile extension 1510 of the liner tile 1504 coupled with the fixed connection 1506. FIG. 33 illustrates a top view, which shows the liner extension 1508, the liner tile extension 1510, and the fixed connection 1506 on the cold side of the liner 1502.

Figure 34:
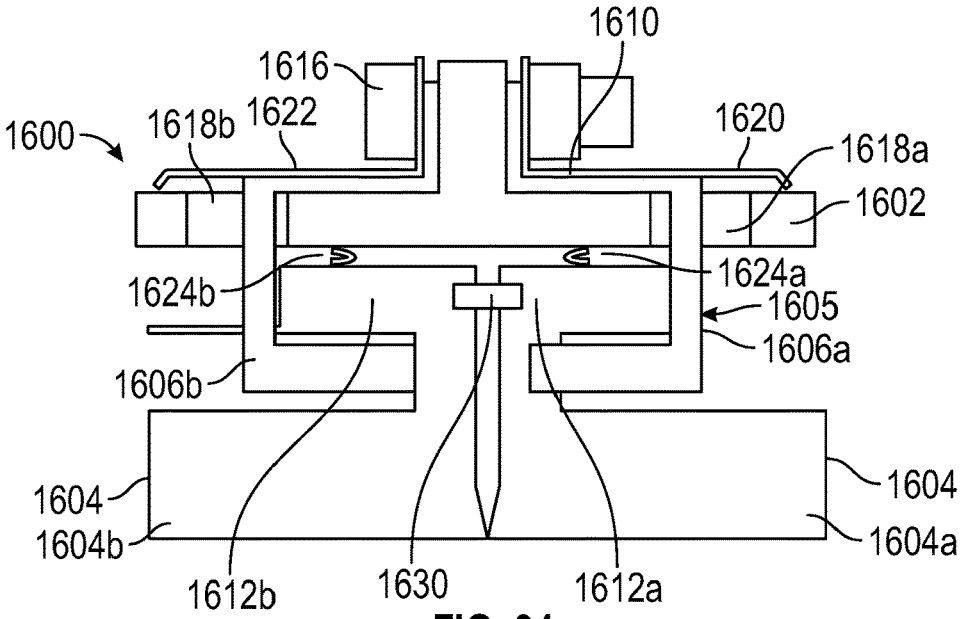
FIG. 34 shows a schematic, side view of a portion of a combustion liner assembly, according to an embodiment of the present disclosure.
Figure 35:
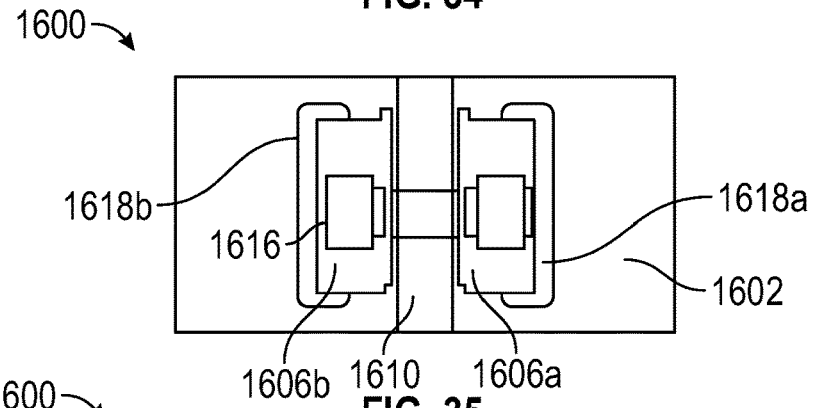
FIG. 35 shows a schematic, top view of a portion of a combustion liner assembly, according to an embodiment of the present disclosure.
Figure 36:
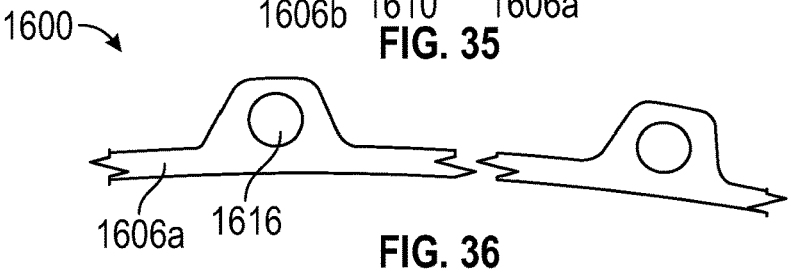
FIG. 36 shows a schematic, side view of a portion of a combustion liner assembly, according to an embodiment of the present disclosure.

FIGS. 34 to 36 illustrate a combustion liner assembly 1600. The combustion liner assembly 1600 includes a liner 1602 and one or more liner tiles 1604 connected together with a connection device 1605. The connection device 1605 may include a first cover 1620, a second cover 1622, a first bracket 1606*a*, a second bracket 1606*b*, a liner connection member 1610, a first liner tile connection member 1612*a* from a first liner tile 1604*a*, a second liner tile connection member 1612*b* from a second liner tile 1604*b*, a W-seal 1630, a first C-seal 1624*a*, a second C-seal 1624*b*, and a fastener 1616. The first bracket 1606*a* may extend through a first liner opening 1618*a* and the second bracket 1606*b* may extend through a second liner opening 1618*b*. The fastener 1616 may secure together the first cover 1620, the first bracket 1606*a*, the liner connection member 1610, the second bracket 1606*b*, and the second cover 1622 on the cold side of the liner 1602. On the hot side of the liner 1602, the first bracket 1606*a* may interface with the first liner tile connection member 1612*a* to secure the first liner tile 1604*a* to the liner 1602, and the second bracket 1606*b* may interface with the second liner tile connection member 1612*b* to secure the second liner tile 1604*b* to the liner 1602. The fastener 1616 may be an axial bolt located on the cold side of the liner 1602.

Figure 37:
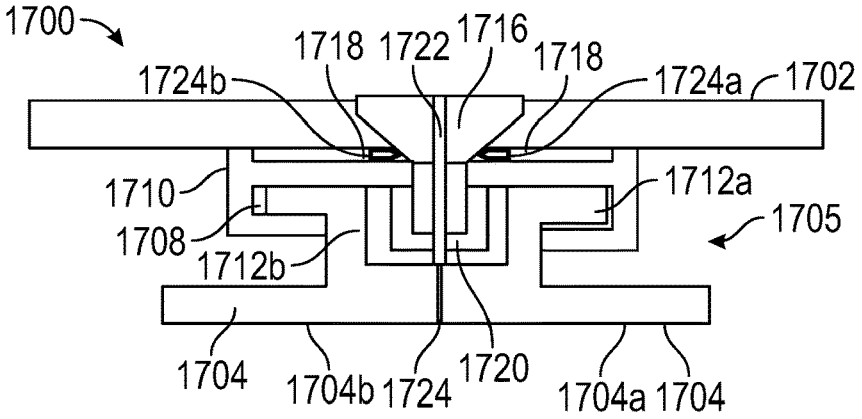
FIG. 37 shows a schematic, side view of a portion of a combustion liner assembly, according to an embodiment of the present disclosure.

FIG. 37 illustrates a combustion liner assembly 1700 that is a variation of the combustion liner assembly 1600. The combustion liner assembly 1700 includes a liner 1702 and one or more liner tiles 1704 connected together with a connection device 1705. The connection device 1705 may include a liner connection member 1710, a fastener 1716, a first liner tile connection member 1712*a* from a first liner tile 1704*a*, a second liner tile connection member 1712*b* from a second liner tile 1704*b*, an insert 1720, a first C-seal 1724*a*, and a second C-seal 1724*b*. The liner connection member 1710 may be a hanger having a first channel 1718 and a second channel 1708. The first channel 1718 may receive the first C-seal 1724*a* and the second C-seal 1724*b* for sealing between the liner connection member 1710 and a radially inward surface of the liner 1702. The second channel 1708 may receive the first liner tile connection member 1712*a* and the second liner tile connection member 1712*b*. The fastener 1716 may be a radial bolt extending through an opening in the liner 1712, an opening in the liner connection member 1710 and be secured with the insert 1720. The insert 1720 may be a threaded insert. A cooling passage 1722 may extend radially through the fastener 1716 to allow cooling through the fastener 1716 and through the space 1724 between the adjacent liner tiles 1704.

In the examples of FIGS. 34 to 37, there is no direct fastening or bolting between the liner tiles and the liner. This may reduce or eliminate stress on the liner tile.

According to embodiments of the present disclosure, connections that are fixed, fastened, and/or bolted may be provided on the cold side of the liner to reduce the wear to the connection. In some examples, although fasteners may extend through the liner to the hot side, the fasteners are protected or shielded from the hot gases on the hot side of the liner via structure attached to the liner and/or liner tiles. In some examples, no radial bolts are presented for fixing the liner to the liner tiles such that the radial bolts are exposed to the hot gases on the hot side of the liner. In some examples of the present disclosure, the CMC liners are inserted through a slot machined in the metallic liner and then bolted. The bolts are aligned in the axial and circumferential direction. In some examples, no radial bolts may be provided. In some examples, flexible leaf springs (also referred to herein as C-seals) are employed to reduce stresses at the bolting locations. Gaps between adjacent liner tiles may be purged with cooling air to reduce the temperatures therein.

The combustion liner assemblies of the present disclosure may provide liner tiles that have one or two splits along an axial direction and/or circumferential direction. The liner and the liner tiles of the present disclosure may have guide rails that may be, but are not limited to, L-shaped, C-shaped, dovetail, etc. The guide rails may form the connection device as described herein. When assembling the liner tile of the present disclosure, the guide rail of the liner tile is inserted into a respective guide rail on the liner in an axial and/or circumferential direction. The gap or the space between circumferentially adjacent liner tiles may be purged with cooling air. The combustion liner assemblies of the present disclosure accommodate differences, even large differences, in the thermal expansion coefficient of the liner and the liner tiles. Any of the aforementioned connection devices may include seals, springs, and/or cooling holes as described herein.

The combustion liner assemblies of the present disclosure may be employed in gas turbine engines, such as for aircraft, marine engines, industrial engines, and/or power generation, etc. The liner assemblies of the present disclosure provide improved assembly of a liner and liner tile as compared to the prior art. The liner assemblies of the present disclosure provide improved liner durability and increased life in time on the wing (when used in aircraft). The liner assemblies of the present disclosure provide ease of maintenance in that a damaged portion of the liner and/or liner tile may be removed and repaired in a standalone fashion, without removal of the entire assembly.

In the examples of the aforementioned combustion liner assemblies, the liner tiles may be formed of ceramic or CMC and/or may have a ceramic or CMC coating thereon. The liner tiles may be inclined in the axially direction and/or the circumferential direction.

As described herein, a feature is included for shielding the liner tile from hot gas ingestion and to protect the connection device and the metal liner. The feature may be a space between an inner radial surface of the metal liner and an outer radial surface of the CMC liner tile. The feature may be one or more openings in the liner, the liner tile, the connection device, or any combination thereof. The feature may be one or more openings in a liner connection member, a liner tile connection member, or both the liner connection member and the liner tile connection member.

Further aspects of the present disclosure are provided by the subject matter of the following clauses.

According to aspects of the present disclosure, a combustion liner assembly includes a metal liner having a hot side and a cold side, a ceramic matrix composite (CMC) liner tile configured to provide a heat shield for the metal liner, the CMC liner tile having a different thermal conductivity than the metal liner, a connection device configured to attach the CMC liner tile to the metal liner, the connection device accommodating the different thermal conductivity of the CMC liner tile and the metal liner, wherein the connection device is free from a radial fastener exposed to hot gases on the hot side of the metal liner, and the connection device allows radial movement and axial movement between the metal liner and the CMC liner tile, and a feature configured to shield the CMC liner tile from hot gas ingestion and to protect the connection device and the metal liner.

The combustion liner assembly the preceding clause, wherein the CMC liner tile includes a plurality of CMC liner tiles, and the connection device includes a plurality of connection devices, each CMC liner tile of the plurality of CMC liner tiles being coupled to the metal liner by at least one of the plurality of connection devices.

The combustion liner assembly of any preceding clause, wherein the feature includes a space between an inner radial surface of the metal liner and an outer radial surface of the CMC liner tile, the space configured to allow cooling air flow therethrough.

The combustion liner assembly of any preceding clause, wherein the metal liner, the CMC liner tile, the connection device, or any combination thereof, include the feature, the feature including openings configured to allow a cooling airflow therethrough.

The combustion liner assembly of any preceding clause, wherein the connection device includes a liner connection member and a liner tile connection member.

The combustion liner assembly of any preceding clause, wherein the liner connection member is a metal liner connection member and the liner tile connection member is a CMC liner tile connection member.

The combustion liner assembly of any preceding clause, further including a seal located between the liner connection member and the liner tile connection member.

The combustion liner assembly of any preceding clause, wherein the feature includes an opening in the liner connection member, the liner tile connection member, or both the liner connection member and the liner tile connection member, the opening configured to allow a cooling airflow therethrough.

The combustion liner assembly of any preceding clause, wherein the liner connection member includes a liner guide channel and the liner tile connection member includes an I-member integral with the liner tile, wherein an upper circumferentially extending member of the I-member is received within the liner guide channel.

The combustion liner assembly of any preceding clause, wherein the connection device further includes a liner opening and a fastener, wherein the liner connection member extends radially outward from an outer surface of the liner and the liner tile connection member extends radially outward from the liner tile and through the liner opening, the fastener extending through the liner connection member and the liner tile connection member.

The combustion liner assembly of any preceding clause, wherein the liner connection member extends radially inward from an inner surface of the metal liner, and the liner tile connection member extends radially outward from an outer surface of the CMC liner tile.

The combustion liner assembly of any preceding clause, wherein each of the liner connection member and the liner tile connection member is L-Shaped.

The combustion liner assembly of any preceding clause, wherein the liner connection member includes a liner guide channel and the liner tile connection member includes a liner tile guide channel, the connection device further including an I-member having an upper circumferentially extending member received within the liner guide channel and a lower circumferentially extending member received with in the liner tile guide channel.

The combustion liner assembly of any preceding clause, the connection device further including a plurality of fasteners extending through the metal liner and the upper circumferentially extending member.

The combustion liner assembly of any preceding clause, further including a second connection device, the second connection device circumferentially connecting the liner tile to an adjacent liner tile or to the metal liner.

The combustion liner assembly of any preceding clause, wherein the second connection device is a shiplap connection with the adjacent liner tile.

The combustion liner assembly of any preceding clause, wherein the second connection device includes a lip on the liner tile interfacing with a liner extension member.

The combustion liner assembly of any preceding clause, wherein the liner tile includes a plurality of liner tiles that are arranged circumferentially around an inner surface of the metal liner and axially along the inner surface of the metal liner.

The combustion liner assembly of any preceding clause, wherein an axial connection between axially adjacent liner tiles of the plurality of liner tiles allows relative motion between the axially adjacent liner tiles.

A gas turbine engine includes a combustion section having a metal liner having a hot side and a cold side, a plurality of CMC liner tiles configured to provide a heat shield on the hot side of the metal liner, the plurality of CMC liner tiles having a different thermal conductivity than the metal liner, and a connection device configured to attach the CMC liner tile to the metal liner, the connection device accommodating the different thermal conductivity of the CMC liner tile and the metal liner, wherein the connection device is free from a radial fastener exposed to hot gases on the hot side of the metal liner, and the connection device allows radial movement and axial movement between the metal liner and the CMC liner tile.

A gas turbine engine includes a combustion liner assembly according to any preceding clause.

Although the foregoing description is directed to the preferred embodiments, it is noted that other variations and modifications will be apparent to those skilled in the art, and may be made without departing from the spirit or scope of the disclosure. Moreover, features described in connection with one embodiment may be used in conjunction with other embodiments, even if not explicitly stated above.

The invention claimed is:

1. A combustion liner assembly comprising:

a metal liner having a hot side and a cold side, the metal liner including a plurality of radially extending liner connection members extending from the hot side thereof and a plurality of circumferentially extending liner connection members each extending from a respective radially extending liner connection member; and a plurality of ceramic matrix composite (CMC) liner tiles for providing a heat shield for the metal liner, each of the plurality of CMC liner tiles including a radially extending liner tile connection member extending from a respective CMC liner tile and a circumferentially extending liner tile connection member extending from the radially extending liner tile connection member, the radially extending liner tile connection member and the circumferentially extending liner tile connection member being configured to engage the plurality of radially extending liner connection members and the plurality of circumferentially extending liner connection members of the metal liner to attach the respective CMC liner tile to the metal liner free from radial fasteners exposed to hot gases on the hot side of the metal liner and to allow radial movement and axial movement between the metal liner and the respective CMC liner tile to accommodate different thermal conductivities of the plurality of CMC liner tiles and of the metal liner, wherein the circumferentially extending liner tile connection member of each of the plurality of CMC liner tiles abuts the hot side of the metal liner, and each of the plurality of circumferentially extending liner connection members of the metal liner abuts an outer radial surface of the respective CMC liner tile.

2. The combustion liner assembly of claim 1, wherein an inner radial surface of the metal liner and the outer radial surface of each of the plurality of CMC liner tiles define a space configured to allow cooling air flow therethrough.

3. The combustion liner assembly of claim 1, wherein each of the plurality of CMC liner tiles further includes a circumferential connection device configured to circumferentially connect the respective CMC liner tile to an adjacent CMC liner tile or to the metal liner.

4. The combustion liner assembly of claim 3, wherein the circumferential connection device is a shiplap connection with the adjacent CMC liner tile.

5. The combustion liner assembly of claim 1, wherein the plurality of CMC liner tiles is arranged circumferentially around the hot side of the metal liner and axially along the hot side of the metal liner.

6. The combustion liner assembly of claim 5, wherein an axial connection between axially adjacent CMC liner tiles of the plurality of CMC liner tiles allows relative motion between the axially adjacent CMC liner tiles.

7. A gas turbine engine comprising:

a combustion section having the combustion liner assembly of claim 1.

8. The combustion liner assembly of claim 1, wherein the radially extending liner tile connection member of each of the plurality of CMC liner tiles defines one or more cooling holes.

9. The combustion liner assembly of claim 1, wherein the radially extending liner tile connection member is a CMC radially extending liner tile connection member and the circumferentially extending liner tile connection member is a CMC circumferentially extending liner tile connection member.

10. The combustion liner assembly of claim 9, wherein the radially extending liner connection member is a metal radially extending liner connection member and the circumferentially extending liner connection member is a metal circumferentially extending liner connection member.

11. The combustion liner assembly of claim 1, wherein the radially extending liner tile connection member and the circumferentially extending liner tile connection member of each of the plurality of CMC liner tiles form an L-shape.

12. The combustion liner assembly of claim 1, further comprising a sealing member disposed between each of the circumferentially extending liner tile connection members of the plurality of CMC liner tiles and the circumferentially extending liner connection members of the metal liner.

13. The combustion liner assembly of claim 12, wherein the sealing member is a C-seal.

14. The combustion liner assembly of claim 1, further comprising a spring disposed within a circumferential gap defined between adjacent radially extending liner tile connection members, the spring being compressible such that a size of the circumferential gap is altered when one or both of the adjacent CMC liner tiles compress the spring and having a stiffness that is selected to ensure a predetermined size of the circumferential gap when one or both of the adjacent CMC liner tiles compress the spring.

15. The combustion liner assembly of claim 14, wherein the spring is a leaf spring.

16. The combustion liner assembly of claim 14, further comprising a sealing member disposed between each of the circumferentially extending liner tile connection members of the plurality of CMC liner tiles and the circumferentially extending liner connection members of the metal liner.

17. The combustion liner assembly of claim 1, wherein the radially extending liner tile connection member and the circumferentially extending liner tile connection member of each of the plurality of CMC liner tiles are a first radially extending liner tile connection member and a first circumferentially extending liner tile connection member that extends from the first radially extending liner tile connection member, each of the plurality of CMC liner tiles further including a second radially extending liner tile connection member and a second circumferentially extending liner tile connection member extending from the second radially extending liner tile connection member.

18. The combustion liner assembly of claim 17, wherein the first circumferentially extending liner tile connection member of the respective CMC liner tile extends circumferentially toward the second radially extending liner tile connection member of the respective CMC liner tile.

19. The combustion liner assembly of claim 17, wherein the first radially extending liner tile connection member extends from a first circumferential end of the respective CMC liner tile and the second radially extending liner tile connection member extends from a second circumferential end of the respective CMC liner tile, opposite the first circumferential end.

* * * * *